US009682425B2

(12) United States Patent
Xu et al.

(10) Patent No.: US 9,682,425 B2
(45) **Date of Patent: *Jun. 20, 2017**

(54) COATED METALLIC POWDER AND METHOD OF MAKING THE SAME

(75) Inventors: Zhiyue Xu, Cypress, TX (US); Gaurav Agrawal, Aurora, CO (US); Bobby Salinas, Sugar Land, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 669 days.

This patent is subject to a terminal disclaimer.

(21) Appl. No.: 12/633,686

(22) Filed: Dec. 8, 2009

(65) Prior Publication Data

US 2011/0135953 A1 Jun. 9, 2011

(51) Int. Cl.
*B22F 1/02* (2006.01)

(52) U.S. Cl.
CPC ..... *B22F 1/025* (2013.01); *B22F 1/02* (2013.01); *B22F 2998/10* (2013.01); *B22F 2999/00* (2013.01); *Y10T 428/12028* (2015.01); *Y10T 428/2991* (2015.01)

(58) Field of Classification Search
None
See application file for complete search history.

(56) References Cited

U.S. PATENT DOCUMENTS

| | | | |
|---|---|---|---|
| 1,468,905 | A | 9/1923 | Herman |
| 2,189,697 | A | 2/1940 | Baker |
| 2,222,233 | A | 11/1940 | Mize |
| 2,225,143 | A | 12/1940 | Baker et al. |
| 2,238,895 | A | 4/1941 | Gage |

(Continued)

FOREIGN PATENT DOCUMENTS

| | | |
|---|---|---|
| CN | 1076968 | 10/1993 |
| CN | 1079234 A | 12/1993 |

(Continued)

OTHER PUBLICATIONS

Abdoulaye Seyni, Nadine Le Bolay, Sonia Molina-Boisseau, "On the interest of using degradable fillers in co-ground composite materials", Powder Technology 190, (2009) pp. 176-184.

(Continued)

*Primary Examiner* — Adam Krupicka
(74) *Attorney, Agent, or Firm* — Cantor Colburn, LLP

(57) ABSTRACT

A metallic powder is disclosed. The metallic powder includes a plurality of metallic powder particles. Each powder particle includes a particle core. The particle core includes a core material comprising Mg, Al, Zn or Mn, or a combination thereof, having a melting temperature ($T_P$). Each powder particle also includes a metallic coating layer disposed on the particle core. The metallic coating layer includes a metallic coating material having a melting temperature ($T_C$). The powder particles are configured for solid-state sintering to one another at a predetermined sintering temperature ($T_S$), and $T_S$ is less than $T_P$ and $T_C$.

17 Claims, 13 Drawing Sheets

(56) References Cited

U.S. PATENT DOCUMENTS 2,261,292 A 11/1941 Salnikov
2,294,648 A 9/1942 Ansel et al.
2,301,624 A 11/1942 Holt
2,352,993 A 7/1944 Albertson
2,394,843 A 2/1946 Cooke et al.
2,672,199 A 3/1948 McKenna
2,753,941 A 7/1956 Hebard et al.
2,754,910 A 7/1956 Derrick et al.
2,933,136 A 4/1960 Ayers et al.
2,983,634 A 5/1961 Budininkas et al.
3,057,405 A 10/1962 Mallinger
3,066,391 A 12/1962 Vordahl
3,106,959 A 10/1963 Huitt et al.
3,142,338 A 7/1964 Brown
3,152,009 A 10/1964 DeLong
3,196,949 A 7/1965 Thomas
3,242,988 A 3/1966 McGuire et al.
3,316,748 A 5/1967 Lang et al.
3,326,291 A 6/1967 Zandmer et al.
3,343,537 A 9/1967 Solis
3,347,317 A 10/1967 Solis
3,347,714 A 10/1967 Broverman et al.
3,390,724 A 7/1968 Caldwell
3,395,758 A 8/1968 Kelly et al.
3,406,101 A 10/1968 Kilpatrick
3,416,918 A 12/1968 Henry
3,465,181 A 9/1969 Colby et al.
3,489,218 A 1/1970 Means
3,513,230 A * 5/1970 Hammar et al. ..... 264/109
3,602,305 A 8/1971 Kisling
3,637,446 A 1/1972 Elliott et al.
3,645,331 A 2/1972 Maurer et al.
3,660,049 A 5/1972 Benjamin
3,765,484 A 10/1973 Hamby, Jr. et al.
3,768,563 A 10/1973 Blount
3,775,823 A 12/1973 Adolph et al.
3,816,080 A 6/1974 Bomford et al.
3,878,889 A 4/1975 Seabourn
3,894,850 A 7/1975 Kovalchuk et al.
3,924,677 A 12/1975 Prenner et al.
4,010,583 A 3/1977 Highberg
4,039,717 A 8/1977 Titus
4,050,529 A 9/1977 Tagirov et al.
4,157,732 A 6/1979 Fonner
4,248,307 A 2/1981 Silberman et al.
4,284,137 A 8/1981 Taylor
4,292,377 A 9/1981 Petersen et al.
4,372,384 A 2/1983 Kinney
4,373,584 A 2/1983 Silberman et al.
4,373,952 A 2/1983 Parent
4,374,543 A 2/1983 Richardson
4,384,616 A 5/1983 Dellinger
4,395,440 A 7/1983 Abe et al.
4,399,871 A 8/1983 Adkins et al.
4,407,368 A 10/1983 Erbstoesser
4,422,508 A 12/1983 Rutledge, Jr. et al.
4,452,311 A 6/1984 Speegle et al.
4,475,729 A 10/1984 Costigan
4,498,543 A 2/1985 Pye et al.
4,499,048 A 2/1985 Hanejko
4,499,049 A 2/1985 Hanejko
4,524,825 A 6/1985 Fore
4,526,840 A 7/1985 Jerabek
4,534,414 A 8/1985 Pringle
4,539,175 A 9/1985 Lichti et al.
4,554,986 A 11/1985 Jones
4,619,699 A 10/1986 Petkovic-Luton et al.
4,640,354 A 2/1987 Boisson
4,664,962 A 5/1987 DesMarais, Jr.
4,668,470 A 5/1987 Gilman et al.
4,673,549 A 6/1987 Ecer
4,674,572 A 6/1987 Gallus
4,678,037 A 7/1987 Smith
4,681,133 A 7/1987 Weston
4,688,641 A 8/1987 Knieriemen
4,690,796 A 9/1987 Paliwal
4,693,863 A 9/1987 Del Corso et al.
4,703,807 A 11/1987 Weston
4,706,753 A 11/1987 Ohkochi et al.
4,708,202 A 11/1987 Sukup et al.
4,708,208 A 11/1987 Halbardier
4,709,761 A 12/1987 Setterberg, Jr.
4,714,116 A 12/1987 Brunner
4,716,964 A 1/1988 Erbstoesser et al.
4,719,971 A 1/1988 Owens
4,721,159 A 1/1988 Ohkochi et al.
4,738,599 A 4/1988 Shilling
4,741,973 A 5/1988 Condit et al.
4,768,588 A 9/1988 Kupsa
4,775,598 A 10/1988 Jaeckel
4,784,226 A 11/1988 Wyatt
4,805,699 A 2/1989 Halbardier
4,817,725 A 4/1989 Jenkins
4,834,184 A 5/1989 Streich et al.
H635 H 6/1989 Johnson et al.
4,850,432 A 7/1989 Porter et al.
4,853,056 A 8/1989 Hoffman
4,869,324 A 9/1989 Holder
4,869,325 A 9/1989 Halbardier
4,880,059 A 11/1989 Brandell et al.
4,889,187 A 12/1989 Terrell et al.
4,890,675 A 1/1990 Dew
4,901,794 A 2/1990 Baugh et al.
4,909,320 A 3/1990 Hebert et al.
4,929,415 A 5/1990 Okazaki
4,932,474 A 6/1990 Schroeder, Jr. et al.
4,938,309 A 7/1990 Emdy
4,938,809 A 7/1990 Das et al.
4,944,351 A 7/1990 Eriksen et al.
4,949,788 A 8/1990 Szarka et al.
4,952,902 A 8/1990 Kawaguchi et al.
4,975,412 A 12/1990 Okazaki et al.
4,977,958 A 12/1990 Miller
4,981,177 A 1/1991 Carmody et al.
4,986,361 A 1/1991 Mueller et al.
4,997,622 A 3/1991 Regazzoni et al.
5,006,044 A 4/1991 Walker, Sr. et al.
5,010,955 A 4/1991 Springer
5,036,921 A 8/1991 Pittard et al.
5,048,611 A 9/1991 Cochran
5,049,165 A 9/1991 Tselesin
5,061,323 A 10/1991 DeLuccia
5,063,775 A 11/1991 Walker, Sr. et al.
5,073,207 A 12/1991 Faure et al.
5,074,361 A 12/1991 Brisco et al.
5,076,869 A 12/1991 Bourell et al.
5,084,088 A 1/1992 Okazaki
5,087,304 A 2/1992 Chang et al.
5,090,480 A 2/1992 Pittard et al.
5,095,988 A 3/1992 Bode
5,103,911 A 4/1992 Heijnen
5,117,915 A 6/1992 Mueller et al.
5,161,614 A 11/1992 Wu et al.
5,171,734 A 12/1992 Sanjurjo et al.
5,178,216 A 1/1993 Giroux et al.
5,181,571 A 1/1993 Mueller et al.
5,183,631 A 2/1993 Kugimiya et al.
5,188,182 A 2/1993 Echols, III et al.
5,188,183 A 2/1993 Hopmann et al.
5,204,055 A 4/1993 Sachs et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,252,365 A 10/1993 White
5,253,714 A 10/1993 Davis et al.
5,271,468 A 12/1993 Streich et al.
5,282,509 A 2/1994 Schurr, III
5,292,478 A 3/1994 Scorey
5,293,940 A 3/1994 Hromas et al.
5,304,260 A 4/1994 Aikawa et al.
5,304,588 A 4/1994 Boysen et al.
5,309,874 A 5/1994 Willermet et al.
5,310,000 A 5/1994 Arterbury et al.

(56) References Cited

U.S. PATENT DOCUMENTS 5,316,598 A 5/1994 Chang et al.
5,318,746 A 6/1994 Lashmore
5,352,522 A 10/1994 Kugimiya et al.
5,380,473 A 1/1995 Bogue et al.
5,387,380 A 2/1995 Cima et al.
5,392,860 A 2/1995 Ross
5,394,236 A 2/1995 Murnick
5,394,941 A 3/1995 Venditto et al.
5,398,754 A 3/1995 Dinhoble
5,407,011 A 4/1995 Layton
5,409,555 A 4/1995 Fujita et al.
5,411,082 A 5/1995 Kennedy
5,417,285 A 5/1995 Van Buskirk et al.
5,425,424 A 6/1995 Reinhardt et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,456,327 A 10/1995 Denton et al.
5,464,062 A 11/1995 Blizzard, Jr.
5,472,048 A 12/1995 Kennedy et al.
5,474,131 A 12/1995 Jordan, Jr. et al.
5,477,923 A 12/1995 Jordan, Jr. et al.
5,479,986 A 1/1996 Gano et al.
5,506,055 A 4/1996 Dorfman et al.
5,507,439 A 4/1996 Story
5,511,620 A 4/1996 Baugh et al.
5,524,699 A 6/1996 Cook
5,526,880 A 6/1996 Jordan, Jr. et al.
5,526,881 A 6/1996 Martin et al.
5,529,746 A 6/1996 Knoss et al.
5,533,573 A 7/1996 Jordan, Jr. et al.
5,536,485 A 7/1996 Kume et al.
5,558,153 A 9/1996 Holcombe et al.
5,601,924 A 2/1997 Beane
5,607,017 A 3/1997 Owens et al.
5,623,993 A 4/1997 Van Buskirk et al.
5,623,994 A 4/1997 Robinson
5,636,691 A 6/1997 Hendrickson et al.
5,641,023 A 6/1997 Ross et al.
5,647,444 A 7/1997 Williams
5,665,289 A 9/1997 Chung et al.
5,677,372 A 10/1997 Yamamoto et al.
5,685,372 A 11/1997 Gano
5,701,576 A 12/1997 Fujita et al.
5,707,214 A 1/1998 Schmidt
5,709,269 A 1/1998 Head
5,720,344 A 2/1998 Newman
5,728,195 A 3/1998 Eastman et al.
5,765,639 A 6/1998 Muth
5,772,735 A 6/1998 Sehgal et al.
5,782,305 A 7/1998 Hicks
5,797,454 A 8/1998 Hipp
5,826,652 A 10/1998 Tapp
5,826,661 A 10/1998 Parker et al.
5,829,520 A 11/1998 Johnson
5,836,396 A 11/1998 Norman
5,857,521 A 1/1999 Ross et al.
5,881,816 A 3/1999 Wright
5,896,819 A 4/1999 Turila et al.
5,902,424 A 5/1999 Fujita et al.
5,934,372 A 8/1999 Muth
5,941,309 A 8/1999 Appleton
5,960,881 A 10/1999 Allamon et al.
5,985,466 A 11/1999 Atarashi et al.
5,988,287 A 11/1999 Jordan, Jr. et al.
5,990,051 A 11/1999 Ischy et al.
5,992,452 A 11/1999 Nelson, II
5,992,520 A 11/1999 Schultz et al.
6,007,314 A 12/1999 Nelson, II
6,024,915 A * 2/2000 Kume et al. ..... 419/48
6,032,735 A 3/2000 Echols
6,036,777 A 3/2000 Sachs
6,047,773 A 4/2000 Zeltmann et al.
6,050,340 A 4/2000 Scott
6,069,313 A 5/2000 Kay
6,076,600 A 6/2000 Vick, Jr. et al.
6,079,496 A 6/2000 Hirth
6,085,837 A 7/2000 Massinon et al.
6,095,247 A 8/2000 Streich et al.
6,119,783 A 9/2000 Parker et al.
6,142,237 A 11/2000 Christmas et al.
6,161,622 A 12/2000 Robb et al.
6,167,970 B1 1/2001 Stout et al.
6,170,583 B1 1/2001 Boyce
6,173,779 B1 1/2001 Smith
6,176,323 B1 1/2001 Weirich et al.
6,189,616 B1 2/2001 Gano et al.
6,189,618 B1 2/2001 Beeman et al.
6,213,202 B1 4/2001 Read, Jr.
6,220,350 B1 4/2001 Brothers et al.
6,220,357 B1 4/2001 Carmichael
6,228,904 B1 5/2001 Yadav et al.
6,237,688 B1 5/2001 Burleson et al.
6,238,280 B1 5/2001 Ritt et al.
6,241,021 B1 6/2001 Bowling
6,248,399 B1 6/2001 Hehmann
6,250,392 B1 6/2001 Muth
6,261,432 B1 7/2001 Huber et al.
6,273,187 B1 8/2001 Voisin, Jr. et al.
6,276,452 B1 8/2001 Davis et al.
6,276,457 B1 8/2001 Moffatt et al.
6,279,656 B1 8/2001 Sinclair et al.
6,287,445 B1 9/2001 Lashmore et al.
6,302,205 B1 10/2001 Ryll
6,315,041 B1 11/2001 Carlisle et al.
6,315,050 B2 11/2001 Vaynshteyn et al.
6,325,148 B1 12/2001 Trahan et al.
6,328,110 B1 12/2001 Joubert
6,341,653 B1 1/2002 Firmaniuk et al.
6,341,747 B1 1/2002 Schmidt et al.
6,349,766 B1 2/2002 Bussear et al.
6,354,372 B1 3/2002 Carisella et al.
6,354,379 B2 3/2002 Miszewski et al.
6,357,322 B1 3/2002 Dolan et al.
6,371,206 B1 4/2002 Mills
6,372,346 B1 4/2002 Toth
6,382,244 B2 5/2002 Vann
6,390,195 B1 5/2002 Nguyen et al.
6,390,200 B1 5/2002 Allamon et al.
6,394,180 B1 5/2002 Berscheidt et al.
6,394,185 B1 5/2002 Constien
6,397,950 B1 6/2002 Streich et al.
6,401,547 B1 6/2002 Hatfield et al.
6,403,210 B1 6/2002 Stuivinga et al.
6,408,946 B1 6/2002 Marshall et al.
6,419,023 B1 7/2002 George et al.
6,439,313 B1 8/2002 Thomeer et al.
6,446,717 B1 9/2002 White et al.
6,457,525 B1 10/2002 Scott
6,467,546 B2 10/2002 Allamon et al.
6,470,965 B1 10/2002 Winzer
6,491,097 B1 12/2002 ONeal et al.
6,491,116 B2 12/2002 Berscheidt et al.
6,513,598 B2 2/2003 Moore et al.
6,513,600 B2 2/2003 Ross
6,535,604 B1 3/2003 Provencal et al.
6,540,033 B1 4/2003 Sullivan et al.
6,543,543 B2 4/2003 Muth
6,561,275 B2 5/2003 Glass et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,609,569 B2 8/2003 Howlett et al.
6,612,826 B1 9/2003 Bauer et al.
6,613,383 B1 9/2003 George et al.
6,619,400 B2 9/2003 Brunet
6,630,008 B1 10/2003 Meeks, III et al.
6,634,428 B2 10/2003 Krauss et al.
6,662,886 B2 12/2003 Russell
6,675,889 B1 1/2004 Mullins et al.
6,699,305 B2 3/2004 Myrick

(56) References Cited

U.S. PATENT DOCUMENTS

| | | | |
|---|---|---|---|
| 6,712,153 | B2 | 3/2004 | Turley et al. |
| 6,712,797 | B1 | 3/2004 | Southern, Jr. |
| 6,713,177 | B2 | 3/2004 | George et al. |
| 6,715,541 | B2 | 4/2004 | Pedersen et al. |
| 6,719,051 | B2 | 4/2004 | Hailey, Jr. et al. |
| 6,755,249 | B2 | 6/2004 | Robison et al. |
| 6,769,491 | B2 | 8/2004 | Zimmerman et al. |
| 6,776,228 | B2 | 8/2004 | Pedersen et al. |
| 6,779,599 | B2 | 8/2004 | Mullins et al. |
| 6,799,638 | B2 | 10/2004 | Butterfield, Jr. |
| 6,810,960 | B2 | 11/2004 | Pia |
| 6,817,414 | B2 | 11/2004 | Lee |
| 6,831,044 | B2 | 12/2004 | Constien |
| 6,883,611 | B2 | 4/2005 | Smith et al. |
| 6,887,297 | B2 | 5/2005 | Winter et al. |
| 6,896,049 | B2 | 5/2005 | Moyes |
| 6,896,061 | B2 | 5/2005 | Hriscu et al. |
| 6,899,176 | B2 | 5/2005 | Hailey, Jr. et al. |
| 6,899,777 | B2 | 5/2005 | Vaidyanathan et al. |
| 6,908,516 | B2 | 6/2005 | Hehmann et al. |
| 6,913,827 | B2 | 7/2005 | George et al. |
| 6,926,086 | B2 | 8/2005 | Patterson et al. |
| 6,932,159 | B2 | 8/2005 | Hovem |
| 6,939,388 | B2 | 9/2005 | Angeliu |
| 6,945,331 | B2 | 9/2005 | Patel |
| 6,951,331 | B2 | 10/2005 | Haughom et al. |
| 6,959,759 | B2 | 11/2005 | Doane et al. |
| 6,973,970 | B2 | 12/2005 | Johnston et al. |
| 6,973,973 | B2 | 12/2005 | Howard et al. |
| 6,983,796 | B2 | 1/2006 | Bayne et al. |
| 6,986,390 | B2 | 1/2006 | Doane et al. |
| 7,013,989 | B2 | 3/2006 | Hammond et al. |
| 7,013,998 | B2 | 3/2006 | Ray et al. |
| 7,017,664 | B2 | 3/2006 | Walker et al. |
| 7,017,677 | B2 | 3/2006 | Keshavan et al. |
| 7,021,389 | B2 | 4/2006 | Bishop et al. |
| 7,025,146 | B2 | 4/2006 | King et al. |
| 7,028,778 | B2 | 4/2006 | Krywitsky |
| 7,044,230 | B2 | 5/2006 | Starr et al. |
| 7,048,812 | B2 | 5/2006 | Bettles et al. |
| 7,049,272 | B2 | 5/2006 | Sinclair et al. |
| 7,051,805 | B2 | 5/2006 | Doane et al. |
| 7,059,410 | B2 | 6/2006 | Bousche et al. |
| 7,090,027 | B1 | 8/2006 | Williams |
| 7,093,664 | B2 | 8/2006 | Todd et al. |
| 7,096,945 | B2 | 8/2006 | Richards et al. |
| 7,096,946 | B2 | 8/2006 | Jasser et al. |
| 7,097,807 | B1 | 8/2006 | Meeks, III et al. |
| 7,097,906 | B2 | 8/2006 | Gardner |
| 7,108,080 | B2 | 9/2006 | Tessari et al. |
| 7,111,682 | B2 | 9/2006 | Blaisdell |
| 7,128,145 | B2 | 10/2006 | Mickey |
| 7,141,207 | B2 | 11/2006 | Jandeska, Jr. et al. |
| 7,150,326 | B2 | 12/2006 | Bishop et al. |
| 7,163,066 | B2 | 1/2007 | Lehr |
| 7,165,622 | B2 | 1/2007 | Hirth et al. |
| 7,168,494 | B2 | 1/2007 | Starr et al. |
| 7,174,963 | B2 | 2/2007 | Bertelsen |
| 7,182,135 | B2 | 2/2007 | Szarka |
| 7,188,559 | B1 | 3/2007 | Vecchio |
| 7,210,527 | B2 | 5/2007 | Walker et al. |
| 7,210,533 | B2 | 5/2007 | Starr et al. |
| 7,217,311 | B2 | 5/2007 | Hong et al. |
| 7,234,530 | B2 | 6/2007 | Gass |
| 7,250,188 | B2 | 7/2007 | Dodelet et al. |
| 7,252,162 | B2 | 8/2007 | Akinlade et al. |
| 7,255,172 | B2 | 8/2007 | Johnson |
| 7,255,178 | B2 | 8/2007 | Slup et al. |
| 7,264,060 | B2 | 9/2007 | Wills |
| 7,267,172 | B2 | 9/2007 | Hofman |
| 7,267,178 | B2 | 9/2007 | Krywitsky |
| 7,270,186 | B2 | 9/2007 | Johnson |
| 7,287,592 | B2 | 10/2007 | Surjaatmadja et al. |
| 7,311,152 | B2 | 12/2007 | Howard et al. |
| 7,316,274 | B2 | 1/2008 | Xu et al. |
| 7,320,365 | B2 | 1/2008 | Pia |
| 7,322,412 | B2 | 1/2008 | Badalamenti et al. |
| 7,322,417 | B2 | 1/2008 | Rytlewski et al. |
| 7,325,617 | B2 | 2/2008 | Murray |
| 7,328,750 | B2 | 2/2008 | Swor et al. |
| 7,331,388 | B2 | 2/2008 | Vilela et al. |
| 7,337,854 | B2 | 3/2008 | Horn et al. |
| 7,346,456 | B2 | 3/2008 | Le Bemadjiel |
| 7,350,582 | B2 | 4/2008 | McKeachnie et al. |
| 7,353,879 | B2 | 4/2008 | Todd et al. |
| 7,360,593 | B2 | 4/2008 | Constien |
| 7,360,597 | B2 | 4/2008 | Blaisdell |
| 7,363,970 | B2 | 4/2008 | Corre et al. |
| 7,373,978 | B2 | 5/2008 | Barry et al. |
| 7,380,600 | B2 | 6/2008 | Willberg et al. |
| 7,387,158 | B2 | 6/2008 | Murray et al. |
| 7,387,165 | B2 | 6/2008 | Lopez de Cardenas et al. |
| 7,392,841 | B2 | 7/2008 | Murray et al. |
| 7,401,648 | B2 | 7/2008 | Richard |
| 7,416,029 | B2 | 8/2008 | Telfer et al. |
| 7,422,058 | B2 | 9/2008 | O'Malley |
| 7,426,964 | B2 | 9/2008 | Lynde et al. |
| 7,441,596 | B2 | 10/2008 | Wood et al. |
| 7,445,049 | B2 | 11/2008 | Howard et al. |
| 7,451,815 | B2 | 11/2008 | Hailey, Jr. |
| 7,451,817 | B2 | 11/2008 | Reddy et al. |
| 7,461,699 | B2 | 12/2008 | Richard et al. |
| 7,464,764 | B2 | 12/2008 | Xu |
| 7,472,750 | B2 | 1/2009 | Walker et al. |
| 7,478,676 | B2 | 1/2009 | East, Jr. et al. |
| 7,503,390 | B2 | 3/2009 | Gomez |
| 7,503,399 | B2 | 3/2009 | Badalamenti et al. |
| 7,509,993 | B1 | 3/2009 | Turng et al. |
| 7,510,018 | B2 | 3/2009 | Williamson et al. |
| 7,513,311 | B2 | 4/2009 | Gramstad et al. |
| 7,516,791 | B2 | 4/2009 | Bryant et al. |
| 7,527,103 | B2 | 5/2009 | Huang et al. |
| 7,537,825 | B1 | 5/2009 | Wardle et al. |
| 7,552,777 | B2 | 6/2009 | Murray et al. |
| 7,552,779 | B2 | 6/2009 | Murray |
| 7,559,357 | B2 | 7/2009 | Clem |
| 7,575,062 | B2 | 8/2009 | East, Jr. |
| 7,579,087 | B2 | 8/2009 | Maloney et al. |
| 7,591,318 | B2 | 9/2009 | Tilghman |
| 7,600,572 | B2 | 10/2009 | Slup et al. |
| 7,604,049 | B2 | 10/2009 | Vaidya et al. |
| 7,604,055 | B2 | 10/2009 | Richard et al. |
| 7,607,476 | B2 | 10/2009 | Tom et al. |
| 7,617,871 | B2 | 11/2009 | Surjaatmadja et al. |
| 7,635,023 | B2 | 12/2009 | Goldberg et al. |
| 7,640,988 | B2 | 1/2010 | Phi et al. |
| 7,661,480 | B2 | 2/2010 | Al-Anazi |
| 7,661,481 | B2 | 2/2010 | Todd et al. |
| 7,665,537 | B2 | 2/2010 | Patel et al. |
| 7,686,082 | B2 | 3/2010 | Marsh |
| 7,690,436 | B2 | 4/2010 | Turley et al. |
| 7,699,101 | B2 | 4/2010 | Fripp et al. |
| 7,703,510 | B2 | 4/2010 | Xu |
| 7,703,511 | B2 | 4/2010 | Buyers et al. |
| 7,708,078 | B2 | 5/2010 | Stoesz |
| 7,709,421 | B2 | 5/2010 | Jones et al. |
| 7,712,541 | B2 | 5/2010 | Loretz et al. |
| 7,723,272 | B2 | 5/2010 | Crews et al. |
| 7,726,406 | B2 | 6/2010 | Xu |
| 7,735,578 | B2 | 6/2010 | Loehr et al. |
| 7,743,836 | B2 | 6/2010 | Cook et al. |
| 7,752,971 | B2 | 7/2010 | Loehr |
| 7,757,773 | B2 | 7/2010 | Rytlewski |
| 7,762,342 | B2 | 7/2010 | Richard et al. |
| 7,770,652 | B2 | 8/2010 | Barnett |
| 7,771,289 | B2 | 8/2010 | Palumbo et al. |
| 7,775,284 | B2 | 8/2010 | Richards et al. |
| 7,775,285 | B2 | 8/2010 | Surjaatmadja et al. |
| 7,775,286 | B2 | 8/2010 | Duphorne |
| 7,784,543 | B2 | 8/2010 | Johnson |
| 7,793,714 | B2 | 9/2010 | Johnson |
| 7,793,820 | B2 | 9/2010 | Hirano et al. |
| 7,798,225 | B2 | 9/2010 | Giroux et al. |
| 7,798,226 | B2 | 9/2010 | Themig |

(56) References Cited

U.S. PATENT DOCUMENTS 7,798,236 B2 9/2010 McKeachnie et al.
7,806,189 B2 10/2010 Frazier
7,806,192 B2 10/2010 Foster et al.
7,810,553 B2 10/2010 Cruickshank et al.
7,810,567 B2 10/2010 Daniels et al.
7,819,198 B2 10/2010 Birckhead et al.
7,828,055 B2 11/2010 Willauer et al.
7,833,944 B2 11/2010 Munoz et al.
7,849,927 B2 12/2010 Herrera
7,851,016 B2 12/2010 Arbab et al.
7,855,168 B2 12/2010 Fuller et al.
7,861,779 B2 1/2011 Vestavik
7,861,781 B2 1/2011 D'Arcy
7,874,365 B2 1/2011 East, Jr. et al.
7,878,253 B2 2/2011 Stowe et al.
7,896,091 B2 3/2011 Williamson et al.
7,897,063 B1 3/2011 Perry et al.
7,900,696 B1 3/2011 Nish et al.
7,900,703 B2 3/2011 Clark et al.
7,909,096 B2 3/2011 Clark et al.
7,909,104 B2 3/2011 Bjorgum
7,909,110 B2 3/2011 Sharma et al.
7,909,115 B2 3/2011 Grove et al.
7,913,765 B2 3/2011 Crow et al.
7,931,093 B2 4/2011 Foster et al.
7,938,191 B2 5/2011 Vaidya
7,946,335 B2 5/2011 Bewlay et al.
7,946,340 B2 5/2011 Surjaatmadja et al.
7,958,940 B2 6/2011 Jameson
7,963,331 B2 6/2011 Surjaatmadja et al.
7,963,340 B2 6/2011 Gramstad et al.
7,963,342 B2 6/2011 George
7,980,300 B2 7/2011 Roberts et al.
7,987,906 B1 8/2011 Troy
7,992,763 B2 8/2011 Vecchio et al.
8,020,619 B1 9/2011 Robertson et al.
8,020,620 B2 9/2011 Daniels et al.
8,025,104 B2 9/2011 Cooke, Jr.
8,028,767 B2 10/2011 Radford et al.
8,033,331 B2 10/2011 Themig
8,039,422 B1 10/2011 Al-Zahrani
8,056,628 B2 11/2011 Whitsitt et al.
8,056,638 B2 11/2011 Clayton et al.
8,109,340 B2 2/2012 Doane et al.
8,127,856 B1 3/2012 Nish
8,153,052 B2 4/2012 Jackson et al.
8,163,060 B2 4/2012 Imanishi et al.
8,211,247 B2 7/2012 Marya et al.
8,211,248 B2 7/2012 Marya
8,226,740 B2 7/2012 Chaumonnot et al.
8,230,731 B2 7/2012 Dyer et al.
8,231,947 B2 7/2012 Vaidya et al.
8,263,178 B2 9/2012 Boulos et al.
8,276,670 B2 10/2012 Patel
8,277,974 B2 10/2012 Kumar et al.
8,327,931 B2 12/2012 Agrawal et al.
8,403,037 B2 3/2013 Agrawal et al.
8,413,727 B2 4/2013 Holmes
8,425,651 B2 4/2013 Xu et al.
8,459,347 B2 6/2013 Stout
8,490,689 B1 7/2013 McClinton et al.
8,535,604 B1 * 9/2013 Baker ..... B22F 1/0003 419/10
8,573,295 B2 11/2013 Johnson
8,631,876 B2 1/2014 Xu et al.
8,956,660 B2 2/2015 Launag et al.
9,079,246 B2 7/2015 Xu et al.
9,080,098 B2 7/2015 Xu et al.
9,090,955 B2 7/2015 Xu et al.
9,101,978 B2 8/2015 Xu et al.
9,243,475 B2 1/2016 Xu
9,260,935 B2 2/2016 Murphree et al.
2001/0040180 A1 11/2001 Wittebrood et al.
2001/0045285 A1 11/2001 Russell
2001/0045288 A1 11/2001 Allamon et al.
2002/0000319 A1 1/2002 Brunet
2002/0007948 A1 1/2002 Bayne et al.
2002/0014268 A1 2/2002 Vann
2002/0020527 A1 2/2002 Kilaas et al.
2002/0047058 A1 4/2002 Verhoff et al.
2002/0066572 A1 6/2002 Muth
2002/0092654 A1 7/2002 Coronado et al.
2002/0096365 A1 7/2002 Berscheidt et al.
2002/0104616 A1 8/2002 De et al.
2002/0108756 A1 8/2002 Harrall et al.
2002/0136904 A1 9/2002 Glass et al.
2002/0139541 A1 10/2002 Sheffield et al.
2002/0162661 A1 11/2002 Krauss et al.
2003/0019639 A1 1/2003 MacKay
2003/0037925 A1 2/2003 Walker et al.
2003/0060374 A1 3/2003 Cooke, Jr.
2003/0075326 A1 4/2003 Ebinger
2003/0104147 A1 6/2003 Bretschneider et al.
2003/0111728 A1 6/2003 Thai et al.
2003/0127013 A1 7/2003 Zavitsanos et al.
2003/0141060 A1 7/2003 Hailey et al.
2003/0141061 A1 7/2003 Hailey et al.
2003/0141079 A1 7/2003 Doane et al.
2003/0150614 A1 8/2003 Brown et al.
2003/0155114 A1 8/2003 Pedersen et al.
2003/0155115 A1 8/2003 Pedersen et al.
2003/0159828 A1 8/2003 Howard et al.
2003/0164237 A1 9/2003 Butterfield
2003/0183391 A1 10/2003 Hriscu et al.
2003/0226668 A1 12/2003 Zimmerman et al.
2004/0005483 A1 1/2004 Lin
2004/0020832 A1 2/2004 Richards et al.
2004/0031605 A1 2/2004 Mickey
2004/0045723 A1 3/2004 Slup et al.
2004/0055758 A1 3/2004 Brezinski et al.
2004/0058167 A1 3/2004 Arbab et al.
2004/0069502 A1 4/2004 Luke
2004/0089449 A1 5/2004 Walton et al.
2004/0094297 A1 5/2004 Malone et al.
2004/0154806 A1 8/2004 Bode et al.
2004/0159428 A1 8/2004 Hammond et al.
2004/0159446 A1 8/2004 Haugen et al.
2004/0182583 A1 9/2004 Doane et al.
2004/0216868 A1 11/2004 Owen, Sr.
2004/0231845 A1 11/2004 Cooke, Jr.
2004/0251025 A1 12/2004 Giroux et al.
2004/0256109 A1 12/2004 Johnson
2004/0256157 A1 12/2004 Tessari et al.
2004/0261993 A1 12/2004 Nguyen
2004/0261994 A1 12/2004 Nguyen et al.
2005/0034876 A1 2/2005 Doane et al.
2005/0051329 A1 3/2005 Blaisdell
2005/0064247 A1 3/2005 Sane et al.
2005/0069449 A1 3/2005 Jackson et al.
2005/0074612 A1 4/2005 Eklund et al.
2005/0098313 A1 5/2005 Atkins et al.
2005/0102255 A1 5/2005 Bultman
2005/0106316 A1 5/2005 Rigney et al.
2005/0126334 A1 6/2005 Mirchandani
2005/0161212 A1 7/2005 Leismer et al.
2005/0161224 A1 7/2005 Starr et al.
2005/0165149 A1 7/2005 Chanak et al.
2005/0194143 A1 9/2005 Xu et al.
2005/0199401 A1 9/2005 Patel et al.
2005/0205264 A1 9/2005 Starr et al.
2005/0205265 A1 9/2005 Todd et al.
2005/0205266 A1 9/2005 Todd et al.
2005/0235757 A1 10/2005 De Jonge et al.
2005/0241824 A1 11/2005 Burris, II et al.
2005/0241825 A1 11/2005 Burris, II et al.
2005/0257936 A1 11/2005 Lehr
2005/0268746 A1 12/2005 Abkowitz et al.
2005/0269097 A1 12/2005 Towler
2005/0275143 A1 12/2005 Toth
2005/0279501 A1 12/2005 Surjaatmadja et al.
2006/0012087 A1 1/2006 Matsuda et al.
2006/0013350 A1 1/2006 Akers
2006/0045787 A1 * 3/2006 Jandeska et al. ..... 419/47
2006/0057479 A1 3/2006 Niimi et al.

(56) References Cited

U.S. PATENT DOCUMENTS

2006/0081378 A1 4/2006 Howard et al.
2006/0102871 A1 5/2006 Wang et al.
2006/0108114 A1 5/2006 Johnson et al.
2006/0108126 A1 5/2006 Horn et al.
2006/0110615 A1 5/2006 Karim et al.
2006/0116696 A1 6/2006 Odermatt et al.
2006/0124310 A1 6/2006 Lopez de Cardenas et al.
2006/0124312 A1 6/2006 Rytlewski et al.
2006/0131011 A1 6/2006 Lynde et al.
2006/0131031 A1 6/2006 McKeachnie et al.
2006/0131081 A1 6/2006 Mirchandani et al.
2006/0144515 A1 7/2006 Tada et al.
2006/0150770 A1 7/2006 Freim et al.
2006/0151178 A1 7/2006 Howard et al.
2006/0153728 A1 7/2006 Schoenung et al.
2006/0162927 A1 7/2006 Walker et al.
2006/0169453 A1 8/2006 Savery et al.
2006/0186602 A1 8/2006 Martin et al.
2006/0207763 A1 9/2006 Hofman et al.
2006/0213670 A1 9/2006 Bishop et al.
2006/0231253 A1 10/2006 Vilela et al.
2006/0283592 A1 12/2006 Sierra et al.
2007/0017674 A1 1/2007 Blaisdell
2007/0017675 A1 1/2007 Hammami et al.
2007/0029082 A1 2/2007 Giroux et al.
2007/0039161 A1 2/2007 Garcia
2007/0039741 A1 2/2007 Hailey
2007/0044958 A1 3/2007 Rytlewski et al.
2007/0044966 A1 3/2007 Davies et al.
2007/0051521 A1 3/2007 Fike et al.
2007/0053785 A1 3/2007 Hetz et al.
2007/0054101 A1 3/2007 Sigalas et al.
2007/0057415 A1 3/2007 Katagiri et al.
2007/0062644 A1 3/2007 Nakamura et al.
2007/0074873 A1 4/2007 McKeachnie et al.
2007/0102199 A1 5/2007 Smith et al.
2007/0107899 A1 5/2007 Werner et al.
2007/0107908 A1 5/2007 Vaidya et al.
2007/0108060 A1 5/2007 Park
2007/0119600 A1 5/2007 Slup et al.
2007/0131912 A1 6/2007 Simone et al.
2007/0134496 A1 6/2007 Ka
2007/0151009 A1 7/2007 Conrad et al.
2007/0151769 A1 7/2007 Slutz et al.
2007/0169935 A1 7/2007 Akbar et al.
2007/0181224 A1 8/2007 Marya et al.
2007/0185655 A1 8/2007 Le Bemadjiel
2007/0187095 A1 8/2007 Walker et al.
2007/0207182 A1 9/2007 Weber et al.
2007/0221373 A1 9/2007 Murray
2007/0221384 A1 9/2007 Murray
2007/0227745 A1 10/2007 Roberts et al.
2007/0259994 A1 11/2007 Tour et al.
2007/0261862 A1 11/2007 Murray
2007/0272411 A1 11/2007 Lopez De Cardenas et al.
2007/0272413 A1 11/2007 Rytlewski et al.
2007/0277979 A1 12/2007 Todd et al.
2007/0284109 A1 12/2007 East et al.
2007/0284112 A1 12/2007 Magne et al.
2007/0299510 A1 12/2007 Venkatraman et al.
2008/0011473 A1 1/2008 Wood et al.
2008/0020923 A1 1/2008 Debe et al.
2008/0047707 A1 2/2008 Boney et al.
2008/0060810 A9 3/2008 Nguyen et al.
2008/0066923 A1 3/2008 Xu
2008/0066924 A1 3/2008 Xu
2008/0078553 A1 4/2008 George
2008/0081866 A1 4/2008 Gong et al.
2008/0093073 A1 4/2008 Bustos et al.
2008/0099209 A1 5/2008 Loretz et al.
2008/0105438 A1 5/2008 Jordan et al.
2008/0115932 A1 5/2008 Cooke
2008/0121390 A1 5/2008 O'Malley et al.
2008/0121436 A1 5/2008 Slay et al.
2008/0127475 A1 6/2008 Griffo
2008/0135249 A1 6/2008 Fripp et al.
2008/0149325 A1 6/2008 Crawford
2008/0149345 A1 6/2008 Marya et al.
2008/0149351 A1 6/2008 Marya et al.
2008/0169105 A1 7/2008 Williamson et al.
2008/0169130 A1 7/2008 Norman et al.
2008/0179060 A1 7/2008 Surjaatmadja et al.
2008/0179104 A1 7/2008 Zhang et al.
2008/0196801 A1 8/2008 Zhao et al.
2008/0202764 A1 8/2008 Clayton et al.
2008/0202814 A1 8/2008 Lyons et al.
2008/0210473 A1 9/2008 Zhang et al.
2008/0216383 A1 9/2008 Pierick et al.
2008/0223586 A1 9/2008 Barnett
2008/0223587 A1 9/2008 Cherewyk
2008/0236829 A1 10/2008 Lynde
2008/0236842 A1 10/2008 Bhavsar et al.
2008/0248205 A1 10/2008 Blanchet et al.
2008/0248413 A1 10/2008 Ishii et al.
2008/0264205 A1 10/2008 Zeng et al.
2008/0264594 A1 10/2008 Lohmueller et al.
2008/0277109 A1 11/2008 Vaidya
2008/0277980 A1* 11/2008 Koda et al. ..... 297/215.16
2008/0282924 A1 11/2008 Saenger et al.
2008/0296024 A1 12/2008 Huang et al.
2008/0302538 A1 12/2008 Hofman
2008/0314581 A1 12/2008 Brown
2008/0314588 A1 12/2008 Langlais et al.
2009/0038858 A1 2/2009 Griffo et al.
2009/0044946 A1 2/2009 Schasteen et al.
2009/0044949 A1 2/2009 King et al.
2009/0050334 A1 2/2009 Marya et al.
2009/0056934 A1 3/2009 Xu
2009/0065216 A1 3/2009 Frazier
2009/0074603 A1 3/2009 Chan et al.
2009/0084553 A1 4/2009 Rytlewski et al.
2009/0084556 A1 4/2009 Richards et al.
2009/0084600 A1 4/2009 Severance
2009/0090440 A1 4/2009 Kellett
2009/0107684 A1 4/2009 Cooke
2009/0114381 A1 5/2009 Stroobants
2009/0114382 A1 5/2009 Grove et al.
2009/0126436 A1 5/2009 Fly et al.
2009/0139720 A1 6/2009 Frazier
2009/0145666 A1 6/2009 Radford et al.
2009/0151949 A1 6/2009 Marya et al.
2009/0152009 A1 6/2009 Slay et al.
2009/0155616 A1 6/2009 Thamida et al.
2009/0159289 A1 6/2009 Avant et al.
2009/0178808 A1 7/2009 Williamson et al.
2009/0194273 A1 8/2009 Surjaatmadja et al.
2009/0205841 A1 8/2009 Kluge et al.
2009/0211770 A1 8/2009 Nutley et al.
2009/0226340 A1 9/2009 Marya
2009/0226704 A1 9/2009 Kauppinen et al.
2009/0242202 A1 10/2009 Rispler et al.
2009/0242208 A1 10/2009 Bolding
2009/0242214 A1 10/2009 Foster et al.
2009/0255667 A1 10/2009 Clem et al.
2009/0255684 A1 10/2009 Bolding
2009/0255686 A1 10/2009 Richard et al.
2009/0260817 A1 10/2009 Gambier et al.
2009/0266548 A1 10/2009 Olsen et al.
2009/0272544 A1 11/2009 Giroux et al.
2009/0283270 A1 11/2009 Langeslag
2009/0293672 A1 12/2009 Mirchandani et al.
2009/0301730 A1 12/2009 Gweily
2009/0305131 A1 12/2009 Kumar et al.
2009/0308588 A1 12/2009 Howell et al.
2009/0317556 A1 12/2009 Macary
2009/0317622 A1 12/2009 Huang et al.
2010/0003536 A1 1/2010 Smith et al.
2010/0012385 A1 1/2010 Drivdahl et al.
2010/0015002 A1 1/2010 Barrera et al.
2010/0015469 A1 1/2010 Romanowski et al.
2010/0025255 A1 2/2010 Su et al.
2010/0032151 A1 2/2010 Duphorne
2010/0034857 A1 2/2010 Launag et al.
2010/0038076 A1 2/2010 Spray et al.

(56) References Cited

U.S. PATENT DOCUMENTS

| | | | |
|---|---|---|---|
| 2010/0038595 | A1 | 2/2010 | Imholt et al. |
| 2010/0040180 | A1 | 2/2010 | Kim et al. |
| 2010/0044041 | A1 | 2/2010 | Smith et al. |
| 2010/0051278 | A1 | 3/2010 | Mytopher et al. |
| 2010/0055491 | A1 | 3/2010 | Vecchio et al. |
| 2010/0055492 | A1 | 3/2010 | Barsoum et al. |
| 2010/0089583 | A1 | 4/2010 | Xu et al. |
| 2010/0089587 | A1 | 4/2010 | Stout |
| 2010/0101803 | A1 | 4/2010 | Clayton et al. |
| 2010/0116495 | A1 | 5/2010 | Spray |
| 2010/0122817 | A1 | 5/2010 | Surjaatmadja et al. |
| 2010/0139930 | A1 | 6/2010 | Patel et al. |
| 2010/0200230 | A1 | 8/2010 | East, Jr. et al. |
| 2010/0236793 | A1 | 9/2010 | Bjorgum |
| 2010/0236794 | A1 | 9/2010 | Duan et al. |
| 2010/0243254 | A1 | 9/2010 | Murphy et al. |
| 2010/0252273 | A1 | 10/2010 | Duphorne |
| 2010/0252280 | A1 | 10/2010 | Swor et al. |
| 2010/0270031 | A1 | 10/2010 | Patel |
| 2010/0276136 | A1 | 11/2010 | Evans et al. |
| 2010/0276159 | A1 | 11/2010 | Mailand et al. |
| 2010/0282338 | A1 | 11/2010 | Gerrard et al. |
| 2010/0282469 | A1 | 11/2010 | Richard et al. |
| 2010/0294510 | A1 | 11/2010 | Holmes |
| 2010/0297432 | A1 | 11/2010 | Sherman et al. |
| 2010/0304182 | A1 | 12/2010 | Facchini et al. |
| 2010/0314105 | A1 | 12/2010 | Rose |
| 2010/0314126 | A1 | 12/2010 | Kellner |
| 2010/0319427 | A1 | 12/2010 | Lohbeck |
| 2010/0319870 | A1 | 12/2010 | Bewlay et al. |
| 2010/0326650 | A1 | 12/2010 | Tran et al. |
| 2011/0005773 | A1 | 1/2011 | Dusterhoft et al. |
| 2011/0036592 | A1 | 2/2011 | Fay |
| 2011/0048743 | A1 | 3/2011 | Stafford et al. |
| 2011/0052805 | A1 | 3/2011 | Bordere et al. |
| 2011/0056692 | A1 | 3/2011 | Lopez de Cardenas et al. |
| 2011/0056702 | A1 | 3/2011 | Sharma et al. |
| 2011/0067872 | A1 | 3/2011 | Agrawal |
| 2011/0067889 | A1 | 3/2011 | Marya et al. |
| 2011/0067890 | A1 | 3/2011 | Themig |
| 2011/0094406 | A1 | 4/2011 | Marya et al. |
| 2011/0100643 | A1 | 5/2011 | Themig et al. |
| 2011/0127044 | A1 | 6/2011 | Radford et al. |
| 2011/0132143 | A1 | 6/2011 | Xu et al. |
| 2011/0132612 | A1 | 6/2011 | Agrawal et al. |
| 2011/0132619 | A1 | 6/2011 | Agrawal et al. |
| 2011/0132620 | A1 | 6/2011 | Agrawal et al. |
| 2011/0132621 | A1 | 6/2011 | Agrawal et al. |
| 2011/0135530 | A1 | 6/2011 | Xu et al. |
| 2011/0135805 | A1 | 6/2011 | Doucet et al. |
| 2011/0135953 | A1 | 6/2011 | Xu et al. |
| 2011/0136707 | A1 | 6/2011 | Xu et al. |
| 2011/0139465 | A1 | 6/2011 | Tibbles et al. |
| 2011/0147014 | A1 | 6/2011 | Chen et al. |
| 2011/0186306 | A1 | 8/2011 | Marya et al. |
| 2011/0214881 | A1 | 9/2011 | Newton et al. |
| 2011/0247833 | A1 | 10/2011 | Todd et al. |
| 2011/0253387 | A1 | 10/2011 | Ervin |
| 2011/0256356 | A1 | 10/2011 | Tomantschger et al. |
| 2011/0259610 | A1 | 10/2011 | Shkurti et al. |
| 2011/0277987 | A1 | 11/2011 | Frazier |
| 2011/0277989 | A1 | 11/2011 | Frazier |
| 2011/0284232 | A1 | 11/2011 | Huang |
| 2011/0284240 | A1 | 11/2011 | Chen et al. |
| 2011/0284243 | A1 | 11/2011 | Frazier |
| 2011/0300403 | A1 | 12/2011 | Vecchio et al. |
| 2011/0314881 | A1 | 12/2011 | Hatcher et al. |
| 2012/0024109 | A1 | 2/2012 | Xu et al. |
| 2012/0067426 | A1 | 3/2012 | Soni et al. |
| 2012/0090839 | A1 | 4/2012 | Rudic |
| 2012/0103135 | A1 | 5/2012 | Xu et al. |
| 2012/0107590 | A1 | 5/2012 | Xu et al. |
| 2012/0118583 | A1 | 5/2012 | Johnson et al. |
| 2012/0130470 | A1 | 5/2012 | Agnew et al. |
| 2012/0145378 | A1 | 6/2012 | Frazier et al. |
| 2012/0145389 | A1 | 6/2012 | Fitzpatrick, Jr. |
| 2012/0168152 | A1 | 7/2012 | Casciaro |
| 2012/0177905 | A1 | 7/2012 | Seals et al. |
| 2012/0205120 | A1 | 8/2012 | Howell |
| 2012/0205872 | A1 | 8/2012 | Reinhardt et al. |
| 2012/0211239 | A1 | 8/2012 | Kritzler et al. |
| 2012/0234546 | A1 | 9/2012 | Xu et al. |
| 2012/0234547 | A1 | 9/2012 | O'Malley et al. |
| 2012/0267101 | A1 | 10/2012 | Cooke, Jr. |
| 2012/0292053 | A1 | 11/2012 | Xu et al. |
| 2012/0318513 | A1 | 12/2012 | Mazyar et al. |
| 2013/0004847 | A1 | 1/2013 | Kumar et al. |
| 2013/0008671 | A1 | 1/2013 | Booth et al. |
| 2013/0025409 | A1 | 1/2013 | Xu |
| 2013/0029886 | A1 | 1/2013 | Mazyar et al. |
| 2013/0032357 | A1 | 2/2013 | Mazyar et al. |
| 2013/0048304 | A1 | 2/2013 | Agrawal et al. |
| 2013/0048305 | A1 | 2/2013 | Xu et al. |
| 2013/0052472 | A1 | 2/2013 | Xu |
| 2013/0081814 | A1 | 4/2013 | Gaudette et al. |
| 2013/0084643 | A1 | 4/2013 | Commarieu et al. |
| 2013/0105159 | A1 | 5/2013 | Alvarez et al. |
| 2013/0126190 | A1 | 5/2013 | Mazyar et al. |
| 2013/0133897 | A1 | 5/2013 | Baihly et al. |
| 2013/0146144 | A1 | 6/2013 | Joseph et al. |
| 2013/0146302 | A1 | 6/2013 | Gaudette et al. |
| 2013/0168257 | A1 | 7/2013 | Mazyar et al. |
| 2013/0186626 | A1 | 7/2013 | Aitken et al. |
| 2013/0240200 | A1 | 9/2013 | Frazier |
| 2013/0240203 | A1 | 9/2013 | Frazier |
| 2013/0299185 | A1 | 11/2013 | Xu et al. |
| 2013/0299192 | A1 | 11/2013 | Xu et al. |
| 2013/0300066 | A1 | 11/2013 | Xu et al. |
| 2013/0319668 | A1 | 12/2013 | Tschetter et al. |
| 2013/0327540 | A1 | 12/2013 | Hamid et al. |
| 2014/0014339 | A1 | 1/2014 | O'Malley et al. |
| 2014/0027128 | A1 | 1/2014 | Johnson |
| 2014/0060834 | A1 | 3/2014 | Quintero et al. |
| 2014/0116711 | A1 | 5/2014 | Tang et al. |
| 2014/0262327 | A1 | 9/2014 | Xu et al. |
| 2014/0360728 | A1 | 12/2014 | Tashiro et al. |
| 2015/0060085 | A1 | 3/2015 | Xu |
| 2015/0065401 | A1 | 3/2015 | Xu et al. |
| 2016/0209391 | A1 | 7/2016 | Zhang et al. |
| 2016/0258242 | A1 | 9/2016 | Hayter et al. |

FOREIGN PATENT DOCUMENTS

| | | | |
|---|---|---|---|
| CN | 1255879 | | 6/2000 |
| CN | 2658384 | Y | 11/2004 |
| CN | 1668545 | A | 9/2005 |
| CN | 1882759 | A1 | 12/2006 |
| CN | 101050417 | A | 10/2007 |
| CN | 101351523 | A | 1/2009 |
| CN | 101454074 | A | 6/2009 |
| CN | 101605963 | | 12/2009 |
| CN | 101457321 | B | 6/2010 |
| CN | 101720378 | A | 6/2010 |
| EA | 008390 | B1 | 4/2007 |
| EA | 200870227 | A1 | 2/2009 |
| EP | 0033625 | A1 | 8/1981 |
| EP | 1006258 | A2 | 6/2000 |
| EP | 1174385 | A2 | 1/2002 |
| EP | 1412175 | B1 | 4/2004 |
| EP | 1798301 | A1 | 8/2006 |
| EP | 1857570 | | 11/2007 |
| FR | 2782096 | A1 | 2/2000 |
| GB | 912956 | | 12/1962 |
| GB | 1046330 | A | 10/1966 |
| GB | 1280833 | A | 7/1972 |
| GB | 1357065 | A | 6/1974 |
| JP | 61067770 | | 4/1986 |
| JP | 7-54008 | | 2/1995 |
| JP | 754008 | A | 2/1995 |
| JP | 08232029 | | 9/1996 |
| JP | 08-232029 | | 10/1996 |
| JP | 2000185725 | A1 | 7/2000 |
| JP | 2002053902 | A | 2/2002 |
| JP | 2004225084 | | 8/2004 |

(56) References Cited

FOREIGN PATENT DOCUMENTS

| | | | |
|---|---|---|---|
| JP | 2004225765 | A | 8/2004 |
| JP | 2005076052 | A | 3/2005 |
| JP | 2009144207 | A | 7/2009 |
| JP | 2010502840 | A | 1/2010 |
| KR | 95-0014350 | | 11/1995 |
| RU | 2373375 | C2 | 11/2009 |
| WO | 9909227 | A1 | 2/1999 |
| WO | 9947726 | | 9/1999 |
| WO | 03008186 | A1 | 1/2003 |
| WO | 2004001087 | A1 | 12/2003 |
| WO | 2004073889 | A1 | 9/2004 |
| WO | 2005040068 | A | 5/2005 |
| WO | 2007044635 | A | 4/2007 |
| WO | 2007095376 | A2 | 8/2007 |
| WO | 2008034042 | A3 | 3/2008 |
| WO | 2008/057045 | A1 | 5/2008 |
| WO | 2008079777 | A3 | 7/2008 |
| WO | WO2008079485 | | 7/2008 |
| WO | 2009079745 | A1 | 7/2009 |
| WO | 2010012184 | A1 | 2/2010 |
| WO | 2011071902 | A3 | 6/2011 |
| WO | 2011071907 | A2 | 6/2011 |
| WO | 2011071910 | A2 | 6/2011 |
| WO | 2011071910 | A3 | 6/2011 |
| WO | 2011130063 | A3 | 2/2012 |
| WO | 2012015567 | A2 | 2/2012 |
| WO | 2012149007 | A2 | 11/2012 |
| WO | 2012164236 | A1 | 12/2012 |
| WO | 2012174101 | A2 | 12/2012 |
| WO | 2013053057 | A1 | 4/2013 |
| WO | 2013078031 | A1 | 5/2013 |
| WO | 2014121384 | A1 | 8/2014 |

OTHER PUBLICATIONS

CH. Christoglou, N. Voudouris, G.N. Angelopoulos, M. Pant, W. Dahl, "Deposition of Aluminum on Magnesium by a CVD Process", Surface and Coatings Technology 184 (2004) 149-155.

Constantin Vahlas, Bri Gitte Caussat, Philippe Serp, George N. Angelopoulos, "Principles and Applications of CVD Powder Technology", Materials Sciene and Engineering R 53 (2006) 1-72.

Guan Ling Song, Andrej Atrens "Corrosion Mechanisms of Magnesium Alloys", Advanced Engineering Materials 1999, 1, No. 1, pp. 11-33.

H. Hermawan, H. Alamdari, D. Mantovani and Dominique Dube, "Iron-manganese: new class of metallic degradable biomaterials prepared by powder metallurgy", Powder Metallurgy, vol. 51, No. 1, (2008), pp. 38-45.

J. Dutta Majumdar, B. Ramesh Chandra, B.L. Mordike, R. Galun, I. Manna, "Laser Surface Engineering of a Magnesium Alloy with Al + Al2O3", Surface and Cotaings Technology 179 (2004) 297-305.

J.E. Gray, B. Luan, "Protective Coatings on Magnesuim and Its Alloys—A Critical Review", Journal of Alloys and Compounds 336 (2002) 88-113.

Yihua Zhu, Chunzhong Li, Qiufang Wu, "The process of coating on ultrafine particles by surface hydrolysis reaction in a fluidized bed reactor", Surface and Coatings Technology 135 (2000) 14-17.

Yi Feng, Hailong Yuan, "Electroless Plating of Carbon Nanotubes with Silver" Journal of Materials Science, 39, (2004) pp. 3241-3243.

E Flahaut et al., "Carbon Nanotube-Metal-Oxide Nanocomposites: Microstructure, Electrical Conductivity and Mechanical Properties" Acta mater. 48 (2000) 3803-3812.

C.S. Goh, J. Wei, L C Lee, and M. Gupta, "Development of novel carbon nanotube reinforced magnesium nanocomposites using the powder metallurgy technique", Nanotechnology 17 (2006) 7-12.

Toru Kuzumaki, Osamu Ujiie, Hideki Ichinose, and Kunio Ito, "Mechanical Characteristics and Preparation of Carbon Nanotube Fiber-Reinforced Ti Composite", Advanced Engineering Materials, 2000, 2, No. 7.

Shimizu et al., "Multi-walled carbon nanotube-reinforced magnesium alloy composites", Scripta Materialia, vol. 58, Issue 4, pp. 267-270.

Jing Sun, Lian Gao, Wei Li, "Colloidal Processing of Carbon NanotubelAlumina Composites" Chem. Mater. 2002, 14, 5169-5172.

Xiaotong Wang et al., "Contact-Damage-Resistant Ceramic/Single-Wall Carbon Nanotubes and Ceramic/Graphite Composites" Nature Materials, vol. 3, Aug. 2004, pp. 539-544.

Y. Zhang and Hongjie Dai, "Formation of metal nanowires on suspended single-walled carbon nanotubes" Applied Physics Letter, vol. 77, No. 19 (2000), pp. 3015-3017.

Guo-Dong Zhan, Joshua D. Kuntz, Julin Wan and Amiya K. Mukherjee, "Single-wall carbon nanotubes as attractive toughening agents in alumina-based nanocomposites" Nature Materials, vol. 2., Jan. 2003. 38-42.

Y. Zhang, Nathan W. Franklin, Robert J. Chen, Hongjie Dai, "Metal Coating on Suspended Carbon Nanotubes and its Implication to Metal—Tube Interaction", Chemical Physics Letters 331 (2000) 35-41.

Notification of Transmittal of the International Search Report and the Written Opinion of the International Searching Authority; PCT/US2011/047000; Korean Intellectual Property Office; Mailed Dec. 26, 2011; 8 pages.

Flow Control Systems, [online]; [retrieved on May 20, 2010]; retrieved from the Internet http://www.bakerhughes.com/products-and-services/completions-and-productions/well-completions/packers-and-flow-control/flow-control-systems.

Optisleeve Sliding Sleeve, [online]; [retrieved on Jun. 25, 2010]; retrieved from the Internet weatherford.com/weatherford/groups/.../weatherfordcorp/WFT033159.pdf.

"Sliding Sleeve", Omega Completion Technology Ltd, Sep. 29, 2009, retrieved on: www.omega-completion.com.

Welch, William R. et al., "Nonelastomeric Sliding Sleeve Maintains Long Term Integrity in HP/HT Application: Case Histories." [Abstract Only], SPE Eastern Regional Meeting, Oct. 23-25, 1996, Columbus. Ohio.

Notification of Transmittal of the International Search Report and the Written Opinion of the International Searching Authority, or the Declaration mailed on Feb. 23, 2012 (Dated Feb. 22, 2012) for PCT/US2011/043036.

International Search Report and Written Opinion of the International Searching Authority, or the Declaration for PCT/US2011/058105 mailed from the Korean Intellectual Property Office on May 1, 2012.

International Search Report and Written Opinion of the International Searching Authority for International Application No. PCT/US2011/058099 (filed on Oct. 27, 2011), mailed on May 11, 2012.

Baker Hughes Tools. "Baker Oil Tools Introduces Revolutionary Sand Control Completion Technology," May 2, 2005.

E. Paul Bercegeay et al., "A One-Trip Gravel Packing System"; Society of Petroleum Engineers, Offshore Technology Conference, SPE Paper No. 4771; Feb. 7-8, 1974.

Bybee, Karen. "One-Trip Completion System Eliminates Perforations," Completions Today, Sep. 2007, pp. 52-53.

Curtin, William and Brian Sheldon. "CNT-reinforced ceramics and metals," Materials Today, 2004, vol. 7, 44-49.

Galanty et al. "Consolidation of metal powders during the extrusion process," Journal of Materials Processing Technology (2002), pp. 491-496.

Hjortstam et al. "Can we achieve ultra-low resistivity in carbon nanotube-based metal composites," Applied Physics A (2004), vol. 78, Issue 8, pp. 1175-1179.

Notification of Transmittal of the International Search Report and the Written Opinion of the International Searching Authority; PCT/US2010/059259; International Searching Authority KIPO; Mailed Jun. 13, 2011.

Notification of Transmittal of the International Search Report and the Written Opinion of the International Searching Authority; PCT/US2010/059265; International Searching Authority KIPO; Mailed Jun. 16, 2011.

(56) References Cited

OTHER PUBLICATIONS

Notification of Transmittal of the International Search Report and the Written Opinion of the International Searching Authority; PCT/US2010/059268; International Searching Authority KIPO; Mailed Jun. 17, 2011.
Stephen P. Mathis, "Sand Management: A Review of Approaches and Concerns"; Society of Petroleum Engineers, SPE Paper No. 82240; SPE European Formation Damage Conference, The Hague, The Netherlands, May 13-14, 2003.
Pardo, et al.; "Corrosion Behaviour of Magnesium/Aluminium Alloys in 3.5 wt% NaC1"; Corrosion Science; 50; pp. 823-834; (2008).
Notification of Transmittal of the International Search Report and Written Opinion, Mailed Jul. 8, 2011, International Appln. No. PCT/US2010/059263, Written Opinion 4 Pages, International Search Report 3 Pages.
Song, G. and S. Song. "A Possible Biodegradable Magnesium Implant Material," Advanced Engineering Materials, vol. 9, Issue 4, Apr. 2007, pp. 298-302.
Song, et al.; "Understanding Magnesium Corrosion"; Advanced Engineering Materials; 5; No. 12; pp. 837-858; (2003).
Zeng et al. "Progress and Challenge for Magnesium Alloys as Biomaterials," Advanced Engineering Materials, vol. 10, Issue 8, Aug. 2008, pp. B3-B14.
Ambat, et al.; "Electroless Nickel-Plating on AZ91D Magnesium Alloy: Effect of Substrate Microstructure and Plating Parameters"; Surface and Coatings Technology; 179; pp. 124-134; (2004).
Chang, et al.; "Electrodeposition of Aluminum on Magnesium Alloy in Aluminum Chloride (A1C13)-1-ethy1-3- methylimidazolium chloride (EMIC) Ionic Liquid and Its Corrosion Behavior"; Electrochemistry Communications; 9; pp. 1602-1606; (2007).
Forsyth, et al.; "An Ionic Liquid Surface Treatment for Corrosion Protection of Magnesium Alloy AZ31"; Electrochem. Solid-State Lett./ 9(11); 4 pages.
Forsyth, et al.; "Exploring Corrosion Protection of Mg Via Ionic Liquid Pretreatment"; Surface & Coatings Technology; 201; pp. 4496-4504; (2007).
Hsiao et al.; "Effect of Heat Treatment on Anodization and Electrochemical Behavior of AZ91D Magnesium Alloy"; J. Mater. Res.; 20(10); pp. 2763-2771;(2005).
Hsiao, et al.; "Anodization of AZ91D Magnesium Alloy in Silicate-Containing Electrolytes"; Surface & Coatings Technology; 199; pp. 127-134; (2005).
Hsiao, et al.; "Baking Treatment Effect on Materials Characteristics and Electrochemical Behavior of anodic Film Formed on AZ91D Magnesium Alloy"; Corrosion Science; 49; pp. 781-793; (2007).
Hsiao, et al.; "Characterization of Anodic Films Formed on AZ91D Magnesium Alloy"; Surface & Coatings Technology; 190; pp. 299-308; (2005).
Huo et al.; "Corrosion of AZ91D Magnesium Alloy with a Chemical Conversion Coating and Electroless Nickel Layer"; Corrosion Science: 46; pp. 1467-1477; (2004).
Liu, et al.; "Electroless Nickel Plating on AZ91 Mg Alloy Substrate"; Surface & Coatings Technology; 200; pp. 5087-5093; (2006).
Lunder et al.; "The Role of Mg17A112 Phase in the Corrosion of Mg Alloy AZ91"; Corrosion; 45(9); pp. 741-748; (1989).
Shi et al.; "Influence of the Beta Phase on the Corrosion Performance of Anodised Coatings on Magnesium-Aluminium Alloys"; Corrosion Science; 47; pp. 2760-2777; (2005).
Song, et al.; "Corrosion Mechanisms of Magnesium Alloys"; Advanced Engineering Materials; 1(1); pp. 11-33; (1999).
Song, Guangling; "Recent Progress in Corrosion and Protection of Magnesium Alloys"; Advanced Engineering Materials; 7(7); pp. 563-586; (2005).
Song, et al.; "Influence of Microstructure on the Corrosion of Diecast AZ91D"; Corrosion Science; 41; pp. 249-273; (1999).
Song, et al.; "Corrosion Behaviour of AZ21, AZ501 and AZ91 in Sodium Chloride"; Corrosion Science; 40(10); pp. 1769-1791; (1998).
Zhang, et al; "Study on the Environmentally Friendly Anodizing of AZ91D Magnesium Alloy"; Surface and Coatings Technology: 161; pp. 36-43; (2002).
International Search Report and Written Opinion; Mail Date Jul. 28, 2011; International Application No. PCT/US2010/057763; International Filing date Nov. 23, 2010; Korean Intellectual Property Office; International Search Report 7 pages; Written Opinion 3 pages.
Patent Cooperation Treaty International Search Report and Written Opinion for International Patent Application No. PCT/US2012/034978 filed on Apr. 25, 2012, mailed on Nov. 12, 2012.
Canadian Pat. App. No. 2783241 filed on Dec. 7, 2010, published on Jun. 16, 2011 for "Nanomatrix Powder Metal Compact".
Canadian Pat. App. No. 2783346 filed on Dec. 7, 2010, published on Jun. 16, 2011 for "Engineered Powder Compact Composite Material".
International Search Report and Written Opinion for International application No. PCT/US20121034973 filed on Apr. 25, 2012, mailed on Nov. 29, 2012.
Wikipedia, the free encyclopedia. Reactivity series. http://en.wikipedia.org/w/index.php?title=Reactivity_series&printable=yes downloaded on May 18, 2014. 8 pages.
Constantine, Jesse. "Selective Production of Horizontal Openhole Completions Using ECP and Sliding Sleeve Technology." SPE Rocky Mountain Regional Meeting, May 15-18, 1999, Gillette, Wyoming. [Abstract Only].
E.J. Lavenia, B.Q. Han, J.M. Schoenung: "Cryomilled nanostructured materials: Processing and properties", Materials Science and Engineering A, 493, (2008) 207-214.
Elsayed Ayman, Imai Hisashi, Umeda Junko and Kondoh Katsuyoshi, "Effect of Consolidation and Extrusion Temperatures on Tensile Properties of Hot Extruded ZK61 Magnesium Alloy Gas Atomized Powders via Spark Plasma Sintering" Transacation of JWRI, vol. 38, (2009) No. 2, pp. 31-35.
H. Watarai, Trend of research and development for magnesium alloys-reducing the weight of structural materials in motor vehicles, (2006) Science and technology trends, Quaterly review No. 18, 84-97.
Bing Q. Han, Enrique J. Lavernia and Farghalli A. Mohamed, "Mechanical Properties of Nanostructured Materials", Rev. Adv. Mater. Sci. 9(2005) 1-16.
International Search Report and Written Opinion, International Application No. PCT/US2012/049434, Date of Mailing Feb. 1, 2013, Korean Intellectual Property Office, Written Opinion 4 pages, International Search Report 3 pages.
International Search Report and Written Opinion for PCT Application No. PCT/US2012/044866, dated Jan. 2, 2013, pp. 1-9.
International Search Report and Written Opinion, PCT/US2012/046231, Date of Mailing Jan. 29, 2013, Korean Intellectual Property Office, Written Opinion 6 pages, International Search Report 3 pages.
M. Bououdina, Z. X. Guo, Comparative study of mechanical alloying of (Mg+Al) and (Mg+Al+Ni) mixtures for hydrogen storage, J. Alloys, Compds, 2002, 336, 222-231.
M.Liu, P.J. Uggowitzer, A.V. Nagasekhar, P. Schmutz, M. Easton, G.L. Song, A. Atrens, Calculated phase diagrams and the corrosion of die-cast Mg—Al alloys, Corrosion Science, 2009, 51, 606-619.
Adam J. Maisano, "Cryomilling of Aluminum-Based and Magnesium-Based Metal Powders", Thesis, Virginia Tech, Jan. 13, 2006.
International Search Report and Written Opinion; PCT/US2010/059257; Korean Intellectual Property Office; dated Jul. 27, 2011.
International Search Report and Written Opinion; PCT/US2012/038622; Dated Dec. 6, 2012; 12 pages.
S.L. Lee, C.W. Hsu, F.K. Hsu, C.Y. Chou, C.K. Lin, C.W. Weng, Effects of Ni addition on hydrogen storage properties of Mg17AL12alloy, Materials Chemistry and Physics, 2011, 126, 319-324.
Shumbera et al. "Improved Water Injector Performance in a Gulf of Mexico Deepwater Development Using an Openhole Frac Pack Completion and Downhole Filter System: Case History." SPE Annual Technical Conference and Exhibition, Oct. 5-8, 2003, Denver, Colorado. [Abstract Only].

(56) References Cited

OTHER PUBLICATIONS

T.J. Bastow, S. Celotto, Clustering and formation of nano-precipitates in dilute aluminum and magnesium alloys, Materials science and Engineering, 2003, C23, 757-762.
Vickery, Harold and Christian Bayne, "New One-Trip Multi-Zone Frac Pack System with Positive Positioning." European Petroleum Conference, Oct. 29-31, 2002, Aberdeen, UK. [Abstract Only].
H. Watanabe, T. Mukai, M. Mabuchi and K. Higashi, "Superplastic Deformation Mechanism in Powder Metallurgy Magnesium Alloys and Composites", Acta mater. 49 (2001) pp. 2027-2037.
Xiaowu Nie, Patents of Methods to Prepare Intermetallic Matrix Composites: A Review, Recent Patents on Materials Science 2008, 1, 232-240, Department of Scientific Research, Hunan Railway College of Science and Technology, Zhuzhou, P.R. China.
Baker Oil Tools. "Z-Seal Metal-to-Metal Expandable Sealing Device Uses Expanding Metal in Place of Elastomers," Nov. 6, 2006.
Baker Hughes Incorporated. IN-Tallic Disintegrating Frac Balls. Houston: Baker Hughes Incorporated, 2011. Accessed Mar. 6, 2015.
Baker Hughes, "Multistage", Oct. 31, 2011, BakerHughes.com; accessed Mar. 6, 2015.
International Search Report and Written Opinion; International Application No. PCT/US2012/071742; International Filing Date: Dec. 27, 2012; Date of Mailing: Apr. 22, 2013; 12 pages.
International Search Report and Written Opinion; International Application No. PCT/US2014/058997, International Filing Date: Oct. 3, 2014; Date of Mailing: Jan. 12, 2015; 12 pages.
International Search Report; International Application No. PCT/US2012/044229, International Filing Date: Jun. 26, 2012; Date of Mailing; Jan. 30, 2013; 3 pages.
Murray, "Binary Alloy Phase Diagrams" Int. Met. Rev., 30(5) 1985 vol. 1, pp. 103-187.
Vernon Constien et al., "Development of Reactive Coatings to Protect Sand-Control Screens", SPE 112494, Copyright 2008, Society of Petroleum Engineers, This paper was prepared for presentation at the 2008 SPE International Symposium and Exhibition on for.
"Reactivity series", Wikipedia, http://en.wikipedia.org/w/index.php?title=Reactivity_series&printable=yes downloaded on May 18, 2014. 8 pages.
Adams, et al.; "Thermal stabilities of aromatic acids as geothermal tracers", Geotherrnics, vol. 21, No. 3, 1992, pp. 323-339.
Ayman, et al.; "Effect of Consolidation and Extrusion Temperatures on Tensile Properties of Hot Extruded ZK61 Magnesium Alloy Gas Atomized Powders via Spark Plasma Sintering", Transactions of JWRI, vol. 38 (2009), No. 2, pp. 1-5.
Bastow, et al., "Clustering and formation of nano-precipitates in dilute aluminum and magnesium alloys", Materials Science and Engineering, 2003, C23, 757-762.
Birbilis, et al., "Exploring Corrosion Protection of Mg Via Ionic Liquid Pretreatment", Surface & Coatings Technology; 201, pp. 4496-4504, (2007).
Carrejo, et al., "Improving Flow Assurance in Multi-Zone Fracturing Treatments in Hydrocarben Reservoirs with High Strength Corrodible Tripping Balls"; Society of Petroleum Engineers; SPE Paper No. 151613; Apr. 16, 2012; 6 pages.
Feng, et al., "Electroless Plating of Carbon Nanotubes with Silver" Journal of Materials Science, 39, (2004) pp. 3241-3243.
Flahaut, et al., "Carbon Nanotube-Metal-Oxide Nanocomposites: Microstructure, Electrical Conductivity and Mechanical Properties" Acta amter. 48 (2000), pp. 3803-3812.
Garfield, New One-Trip Sand-Control Completion System that Eliminates Formation Damage Resulting From conventional Perforating and Gravel-Packing Operations:, SPE Annual Technical Conference and Exhibition, Oct. 9-12, 2005.
Garfield, et al., "Maximizing Inflow Performance in Soft Sand Completions Using New One-trip Sand Control Liner Completion Technology", SPE European Formation Damage Conference, May 25-27, 2005.
Goh, et al., "Development of novel carbon nanotube reinforced magnesium nanocomposites using the powder metallurgy technique", Nanottechnology 17 (2006) 7-12.
International Search Report and Written Opinion; International Application No. PCT/US2012/038622; International Filing Date: May 18, 2012; Date of Mailing: Dec. 6, 2012; 12 pages.
International Search Report and Written Opinion; International Application No. PCT/US2012/049434; International Filing Date: Aug. 3, 2012; Date of Mailing: Feb. 1, 2013; 7 pages.
International Search Report and Written Opinion; International Application No. PCT/US2012/053339; International Filing Date: Aug. 31, 2012; Date of Mailing: Feb. 15, 2013; 11 pages.
International Search Report and Written Opinion; International Application No. PCT/US2012/053342; International Filing Date: Aug. 31, 2012; Date of Mailing: Feb. 19, 2013; 9 pages.
International Search Report and Written Opinion; International Application No. PCT/US2012/053350; International Filing Date: Aug. 31, 2012; Date of Mailing: Feb. 25, 2013; 10 pages.
International Search Report and Written Opinion; International Application No. PCT/US2014/049347; International Filing Date: Aug. 1, 2014; Date of Mailing: Nov. 24, 2014; 11 pages.
International Search Report and Written Opinion; International Applicaion No. PCT/US2014/054720; International Filing Date: Sep. 9, 2014; Date or Mailing: Dec. 17, 2014; 10 pages.
Li, et al. "Investigation of aluminium-based nancompsoites with ultra-high strength", Materials Science and Engineering A, 527, pp. 305-316, (2009).
Mathis, "Sand Management: A Review of Approaches and Concerns", Society of Petroleum Engineers, SPE Paper No. 82240, SPE European Formation Damage Conference, the Hague, the Netherlands, May 13-14, 2003.
Nie, "Patents of Methods to Prepare Intermetallic Matrix Composites: A Review", Recent Patents on Materials Science 2008, vol. 1, pp. 232-240.
Rose, et al.; "The application of the polyaromatic sulfonates as tracers in geothermal reservoirs", Geothermics 30 (2001) pp. 617-640.
Seyni, et al., "On the interest of using degradable fillers in co-ground composite materials", Powder Technology 190, (2009) pp. 176-184.
Shaw, "Benefits and Application of a Surface-Controlled Sliding Sleeve for Fracturing Operations"; Society of Petroleum Engineers, SPE Paper No. 147546; Oct. 30, 2011; 8 pages.
Shigematsu, et al., "Surface Treatment of AZ91D Magnesium Alloy by Aluminum diffusion Coating", Journal of Materials Science Letters 19, 2000, pp. 473-475.
Singh, et al., "Extended Homogeneity Range of Intermetallic Phases in Mechanically Alloyed Mg—Al Alloys", Elsevier Sciences Ltd., Intemetallics 11, 2003, pp. 373-376.
Stanley, et al.; "An Introduction to Ground-Water Tracers", Department of Hydrology and Water Resources, University of Arizona, Mar. 1985, pp. 1-219.
Sun, et al.; "Colloidal Processing of Carbon Nanotube/Alumina Composites" Chem. Mater. 2002, 14, pp. 5169-5172.
Walters, et al.; "A Study of Jets from Unsintered-Powder Metal Lined Nonprecision Small-Caliber Shaped Charges", Army Research Laboratory, Aberdeen Proving Ground, MD 21005-5066; Feb. 2001.
Xu, et al., "Nanostructured Material-Based Completion Tools Enhance Well Productivity"; International Petroleum Technology Conference; Conference Paper IPTC 16538; International Petroleum Technology Conference 2013; 4 pages.
Zemel, "Tracers in the Oil Field", University of Texas at Austin, Center for Petroleum and Geosystems, Jan. 1995, Chapters 1, 2, 3, 7.
Zhang, et al.; "High Strength Nanostructured Materials and Their Oil Field Applications"; Society of Petroleum Engineers; Conference Paper SPE 157092; SPE International Oilfield Nanotechnology Conference, 2012; 6 pages.
Aviles et al, "Degradable Alternative to Risky Mill-Out Operations in Plug and Perf"; SPE-173695-MS; Society of Petroleum Engineers; SPE/ICOTA Coiled Tubing & Well Intervention Conference & Exhibition; Mar. 24-25, 2015; 10 Pages.

(56) References Cited

OTHER PUBLICATIONS

Bin et al., "Advances in Fluidization CVD Technology", East China University of Chemical Technology, China Academic Journal Electronic Publishing House, vol. 13, No. 4, Nov. 1992, pp. 360-365, English Abstract on p. 366.
Garry Garfield, "Formation Damage Control Utilizing Composite-Bridge-Plug Technology for Monobore, Multizone Stimulation Operations," SPE 70004, 2001, Society of Petroleum Engineers Inc., This paper was prepared for presentation at the SPE Per.
International Preliminary Report on Patentability; PCT/US2013/050475; Mailed Feb. 26, 2015; 10 Pages.
International Search Report and Written Opinion, Date of Mailing Feb. 26, 2013; International Application No. PCT/US2012/047163, Korean Intellectual Property Office; Written Opinion 9 pages, International Search Report 3 pages.
International Search Report and Written Opinion; International Application No. PCT/US2012/052836; International Filing Date: Aug. 29, 2012; Date of Mailing Feb. 1, 2013; 9 pages.
International Search Report for related PCT Application No. PCT/US2013/035258, dated Jul. 4, 2013, pp. 1-4.
International Search Report for related PCT Application No. PCT/US2013/035261, dated Jul. 10, 2013, pp. 1-4.
International Search Report for related PCT Application No. PCT/US2013/035262, dated Jul. 1, 2013, pp. 1-4.
International Search Report for related PCT Application No. PCT/US2013/068062, dated Feb. 12, 2014, pp. 1-3.
Lin et al., "Processing and Microstructure of Nano-Mo/Al2O3 Composites from Mocvd and Fluidized Bed", Nanostructured Materials, Nov. 1999, vol. 11, No. 8, pp. 1361-1377.
M.S. Senthil Saravanan et al., "Mechanically Alloyed Carbon Nanotubes (CNT) Reinforced Nanocrystalline AA 4032: Synthesis and Characterization," Journal of Minerals & Materials Characterization & Engineering, vol. 9, No. 11, pp. 1027-1035, 2010.
M.T. Triolo et al., "Resolving the Completion Engineer's Dilemma: Permanent or Retrievable Packer?"; Society of Petroleum Engineers, SPE Paper No. 76711; May 20, 2002; 16 pages.
Martin P. Coronado, "Development of an Internal Coiled Tubing Connector Utilizing Permanent Packer Technology"; Society of Petroleum Engineers, SPE Paper No. 46036; Apr. 15, 1998; 10 pages.
Notification of Transmittal of the International Search Report and the Written Opinion of the International Searching Authority, or the Declaration; PCT/US2014/010862; 21 Apr. 2014; 9 pages.
Notification of Transmittal of the International Search Report on Patentability and the Written Opinion of the International Searching Authority, or the Declaration; PCT/US2013/020046;Apr. 10, 2013, 7 pages.
Quik Drill Composite Frac Plug; Baker Hughes, Baker Oil Tools; Copyright 2002; 3 pages.
S.R. Bakshi et al., "Carbon nanotube reinforced metal matrix composites—a review," International Materials Reviews; 2010, pp. 41-64, vol. 55, No. 1.
Simulia Realistic Simulation News, [online]; [retrieved on Jan. 10, 2013]; retrieved from the intemet http://www.3ds.com/fileadmin/brands/SIMULIA/Customer_Stories/Baker_Hughes/Energy_BakerHughes_RSN_Feb11.pdf, Baker Hughes Refines Expandable Tubular.
Spencer et al., "Fluidized Bed Polymer Particle ALD Process for Producing Hdpe/Alumina Nanocomposites" in "The 12th International Conference on Fluidization—New Horizons in Fluidization Engineering"[ . . . ] vol. RP4 (2007).
Australian Examination Report for Australian patent application No. 2012302067 dated Sep. 22, 2015.
Australian Examination Report; Australian Application No. 2012287461; Date of Mailing: Jul. 13, 2015; 6 pages.
Aviles et al, "Degradable Alternative to Risky Mill-Out Operations in Plug and Perf"; SPE-173695-MS; Society of Petroleum Engineers; SPE/ICOTA Coiled Tubing & Well Intervention Conference & Exhibition; Mar. 15-18, 2015; 10 Pages.
Chinese Office Action for Chinese Application No. 201280036477.4, dated Nov. 4, 2015, pp. 1-15.
Chinese Office Action; Chinese Application No. 201280020572.5; Mailing Date:Oct. 10, 2015; 13 pages.
Chuan-Jun et al., "Study on Corrosion Kinetics of Mg—Ni alloys", Journal of Kunming University of Science and Technology, vol. 34, No. 5, pp. 10-13, Oct. 2009.
European Search Report for EP Application No. 10836533.9 dated Jul. 27, 2015.
European Search Report for EP Application No. 10836538.8 dated Jul. 27, 2015.
European Search Report for EP Application No. 10836539.6 dated Jul. 27, 2015.
European Search Report for EP Application No. 10836540.4 dated Aug. 20, 2015.
International Search Report for related PCT Application No. PCT/US20131035258, dated Jul. 4, 2013, pp. 1-4.
International Search Report for related PCT Application No. PCT/US20131035261, dated Jul. 10, 2013, pp. 1-4.
International Search Report for related PCT Application No. PCT/US20131035262, dated Jul. 1, 2013, pp. 1-4.
International Search Report for related PCT Application No. PCT/US20131068062, dated Feb. 12, 2014, pp. 1-3.
Tsipas et al. "Effect of High Energy Ball Milling on Titanium-Hydroxyapatite Powders" Powder Metallurgy, Maney Publishing, London, GB, vol. 46, No. 1, Mar. 2003 (Mar. 2003), pp. 73-77.
Australian Office Action for Patent Application No. 2012302067; Date of Issue Feb. 2, 2015, 3 pages.
Australian Patent Examination Report for Patent Application No. 2012302067 dated Sep. 22, 2015, 3 pages.
Canadian Office Action for Application No. 2860699; Date of Mailing Oct. 7, 2015, 4 pages.
Canadian Office Action for Canadian Application No. 2,841,068, dated Nov. 9, 2015, pp. 14.
Chinese Office Action for Chinese Application No. 201280041320.0; Date of Mailing Jun. 6, 2016, 14 pages.
Chinese Office Action for Chinese Application No. 201380006291.9 dated Apr. 27, 2016, 25 pages.
Chinese Office Action for Chinese Patent Application No. 201280041531.4 dated Aug. 31, 2015.
Office Action issued on Mar. 23, 2016 in related EP Patent Application No. 12827733.2.
European Search Report for EP Application No. 12827733.2 dated Jan. 21, 2015; 6 pages.
European Search Report for EP Application No. 12827915.5 dated Dec. 23, 2015; 8 pages.
European Search Report for EP Application No. 12828903.0 dated Dec. 23, 2015.
European Search Report for European Application No. 12820355.Jan. 1353, dated Dec. 18, 2015, 9 pages.
Extended European Search Report for EP Application No. 12828379.3-1373, dated May 20, 2016, 8 pages.
Extended European Search Report; EP Application No. 12822169A-1605/2739812; Mailing Date: Nov. 17, 2015; pages.
International Search Report and Written Opinion; International Application No. PCT/US2015/066353; International filing Date: Dec. 17, 2015; Date of Mailing: Apr. 1, 2016; 14 pages.
M.S. Senthil Saravanan et al, "Mechanically Alloyed Carbon Nanotubes (CNT) Reinforced Vanocrystalline AA 4032: Synthesis and Characterization", Journal of Minerals and Materials Characterization and Engineering, vol. 9, No. 11 pp. 1027-1035 2010.
Malaysian Search Report for Application No. PI 2012002545 dated May 31, 2016, 3 pages.
Office Action issued on Feb. 1, 2016 in related Canadian Patent Application No. 2,844,517, 4 pages.
Reid, Gary Carl, "Literature evaluation of induced groundwater tracers, field tracer techniques, and hydrodynamic dispersion values in porous media", Theisis in Geosciences (Masters), Texas Tech University, Aug. 1981, 109 pages.
International Search Report and Written Opinion, International Application No. PCT/US2016/041849, Date of Mailing Oct. 26, 2016, Korean Intellectual Property Office; International Search Report 5 pages, Written Opinion 7 pages.

(56) References Cited

OTHER PUBLICATIONS

"Declaration of Karl T. Hartwig in Support of Petitioner Pursuant to 37 C.F.R. §42.120", executed on Nov. 21, 2016 in support of U.S. Pat. No. 8,573,295, 52 pages.
"Declaration of Karl T. Hartwig in Support of Petitioner Pursuant to 37 C.F.R. §42.120", executed on Nov. 21, 2016 in support of U.S. Pat. No. 9,101,978, 51 pages.
AP African Office Action for African Application No. AP/P/2014/007389, dated Oct. 6, 2016, 5 pages.
Callister, Jr., William D., Materials Science and Engineering an Introduction, Seventh Edition, 2006, pp. 111, 627, and G7.
German, Randall M., Powder Metallurgy Science, Second Edition, 1994, 102 pages.
Klar, Erhard, ASM Handbook: International Metals Handbook—Powder Metallurgy, vol. 7, 1997, pp. 14, 276, and 798.
Petition for Inter Partes Review; Case No. IPR2017-00326; U.S. Pat. No. 9,101,978; Nov. 23, 2016; 46 pages.
Petition for Inter Partes Review; Case No. IPR2017-00327; U.S. Pat. No. 8,573,295; Nov. 23, 2016; 53 pages.
Schaffer, James P. et al., The Science and Design of Engineering Materials, Second Edition, 1999, pp. 122, 123, 598, and 699.
Kie, Guoqiang et al., "TEM Observation of Interfaces between Particles in Al-Mg Alloy Powder Compacts Prepared by Pulse Electric Current Sintering", Materials Transactions, 2002, pp. 2177-2180, vol. 43-No. 9.
Russian Search Report, Russian Application No. 2014149137, Date of Mailing Feb. 8, 2017; 4 pages.
EP Search Report, PCT/US2012049434; Application No. EP 12823958; Date: Jun. 15, 2016; 9 pages.

* cited by examiner

| Material ID | Particle Core | Metallic Coating Layer (e.g., 1st+2nd+3rd) |
|---|---|---|
| DHS1-1 | Mg | No |
| DHS1-2 | Mg | Al |
| DHS1-3 | Mg | Ni + Al |
| DHS1-4 | Mg | W + Al |
| DHS1-5 | Mg | Al + $Al_2O_3$ + Al |
| DHS2-6 | Mg | Al |

COATED METALLIC POWDER AND METHOD OF MAKING THE SAME

CROSS REFERENCE TO RELATED APPLICATIONS

This application contains subject matter related to the subject matter of co-pending applications, which are assigned to the same assignee as this application, Baker Hughes Incorporated of Houston, Tex. and are all being filed on Dec. 8, 2009. The below listed applications are hereby incorporated by reference in their entirety:

U.S. patent application Ser. No. 12/633,682, entitled NANOMATRIX POWDER METAL COMPACT;

U.S. patent application Ser. No. 12/633,688, entitled METHOD OF MAKING A NANOMATRIX POWDER METAL COMPACT;

U.S. patent application Ser. No. 12/633,678, entitled ENGINEERED POWDER COMPACT COMPOSITE MATERIAL;

U.S. patent application Ser. No. 12/633,683, entitled TELESCOPIC UNIT WITH DISSOLVABLE BARRIER;

U.S. patent application Ser. No. 12/633,662 entitled DISSOLVING TOOL AND METHOD;

U.S. patent application Ser. No. 12/633,677 entitled MULTI-COMPONENT DISAPPEARING TRIPPING BALL AND METHOD FOR MAKING THE SAME; and U.S. patent application Ser. No. 12/633,668 entitled DISSOLVING TOOL AND METHOD.

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

In order to eliminate the need for milling or drilling operations, the removal of components or tools by dissolution of degradable polylactic polymers using various wellbore fluids has been proposed. However, these polymers generally do not have the mechanical strength, fracture toughness and other mechanical properties necessary to perform the functions of wellbore components or tools over the operating temperature range of the wellbore, therefore, their application has been limited.

Other degradable materials have been proposed including certain degradable metal alloys formed from certain reactive metals in a major portion, such as aluminum, together with other alloy constituents in a minor portion, such as gallium, indium, bismuth, tin and mixtures and combinations thereof, and without excluding certain secondary alloying elements, such as zinc, copper, silver, cadmium, lead, and mixtures and combinations thereof. These materials may be formed by melting powders of the constituents and then solidifying the melt to form the alloy. They may also be formed using powder metallurgy by pressing, compacting, sintering and the like a powder mixture of a reactive metal and other alloy constituent in the amounts mentioned. These materials include many combinations that utilize metals, such as lead, cadmium, and the like that may not be suitable for release into the environment in conjunction with the degradation of the material. Also, their formation may involve various melting phenomena that result in alloy structures that are dictated by the phase equilibria and solidification characteristics of the respective alloy constituents, and that may not result in optimal or desirable alloy microstructures, mechanical properties or dissolution characteristics.

Therefore, the development of materials that can be used to form wellbore components and tools having the mechanical properties necessary to perform their intended function and then removed from the wellbore by controlled dissolution using wellbore fluids is very desirable.

SUMMARY

An exemplary embodiment of a metallic powder is disclosed. The metallic powder includes a plurality of metallic powder particles. Each powder particle includes a particle core. The particle core includes a core material comprising Mg, Al, Zn or Mn, or a combination thereof, having a melting temperature ($T_P$). Each powder particle also includes a metallic coating layer disposed on the particle core. The metallic coating layer includes a metallic coating material having a melting temperature ($T_C$). The powder particles are configured for solid-state sintering to one another at a predetermined sintering temperature ($T_S$), and $T_S$ is less than $T_P$ and $T_C$.

Another exemplary embodiment of a metallic powder is also disclosed. The metallic powder includes a plurality of metallic powder particles. Each powder particle includes a particle core. The particle core includes a core material comprising a metal having a standard oxidation potential less than Zn, ceramic, glass, or carbon, or a combination thereof, having a melting temperature ($T_P$). Each powder particle also includes a metallic coating layer disposed on the particle core. The metallic coating layer includes a metallic coating material having a melting temperature ($T_C$). The powder particles are configured for solid-state sintering to one another at a predetermined sintering temperature ($T_S$), and $T_S$ is less than $T_P$ and $T_C$.

Yet another exemplary embodiment includes a method of making a metallic powder. The method includes forming a metallic powder comprising a plurality of powder particles comprising Mg, Al, Zn or Mn, or a combination thereof, having a melting temperature ($T_P$), for use as a plurality of particle cores. The method also includes depositing a metallic coating layer on each of the plurality of particle cores, the metallic coating layer having a melting temperature ($T_C$), wherein the powder particles are configured for solid-state sintering to one another at a predetermined sintering temperature ($T_S$), and $T_S$ is less than $T_P$ and $T_C$.

BRIEF DESCRIPTION OF THE DRAWINGS

Referring now to the drawings wherein like elements are numbered alike in the several Figures.

DETAILED DESCRIPTION

Figure 1:
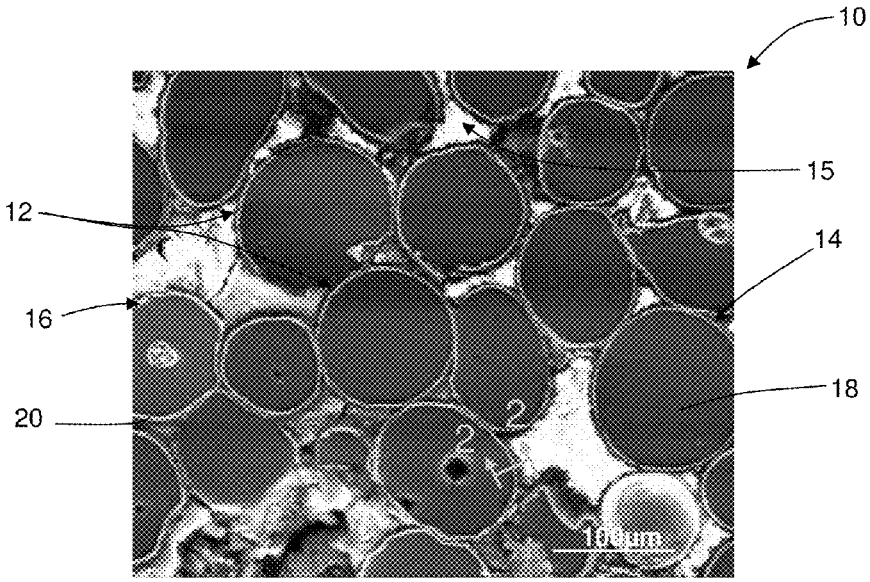
FIG. 1 is a photomicrograph of a powder 10 as disclosed herein that has been embedded in an epoxy specimen mounting material and sectioned.

Lightweight, high-strength metallic materials are disclosed that may be used in a wide variety of applications and application environments, including use in various wellbore environments to make various selectably and controllably disposable or degradable lightweight, high-strength downhole tools or other downhole components, as well as many other applications for use in both durable and disposable or degradable articles. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in wellbore applications. These powder compacts provide a unique and advantageous combination of mechanical strength properties, such as compression and shear strength, low density and selectable and controllable corrosion properties, particularly rapid and controlled dissolution in various wellbore fluids. For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials. As yet another example, these powders and powder compact materials may be configured to provide a selectable and controllable degradation or disposal in response to a change in an environmental condition, such as a transition from a very low dissolution rate to a very rapid dissolution rate in response to a change in a property or condition of a wellbore proximate an article formed from the compact, including a property change in a wellbore fluid that is in contact with the powder compact. The selectable and controllable degradation or disposal characteristics described also allow the dimensional stability and strength of articles, such as wellbore tools or other components, made from these materials to be maintained until they are no longer needed, at which time a predetermined environmental condition, such as a wellbore condition, including wellbore fluid temperature, pressure or pH value, may be changed to promote their removal by rapid dissolution. These coated powder materials and powder compacts and engineered materials formed from them, as well as methods of making them, are described further below.

Referring to FIGS. 1-5, a metallic powder 10 includes a plurality of metallic, coated powder particles 12. Powder particles 12 may be formed to provide a powder 10, including free-flowing powder, that may be poured or otherwise disposed in all manner of forms or molds (not shown) having all manner of shapes and sizes and that may be used to fashion precursor powder compacts 100 (FIG. 16) and powder compacts 200 (FIGS. 10-15), as described herein, that may be used as, or for use in manufacturing, various articles of manufacture, including various wellbore tools and components.

Each of the metallic, coated powder particles 12 of powder 10 includes a particle core 14 and a metallic coating layer 16 disposed on the particle core 14. The particle core 14 includes a core material 18. The core material 18 may include any suitable material for forming the particle core 14 that provides powder particle 12 that can be sintered to form a lightweight, high-strength powder compact 200 having selectable and controllable dissolution characteristics. Suitable core materials include electrochemically active metals having a standard oxidation potential greater than or equal to that of Zn, including as Mg, Al, Mn or Zn or a combination thereof. These electrochemically active metals are very reactive with a number of common wellbore fluids, including any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). Core material 18 may also include other metals that are less electrochemically active than Zn or non-metallic materials, or a combination thereof. Suitable non-metallic materials include ceramics, composites, glasses or carbon, or a combination thereof. Core material 18 may be selected to provide a high dissolution rate in a predetermined wellbore fluid, but may also be selected to provide a relatively low dissolution rate, including zero dissolution, where dissolution of the nanomatrix material causes the particle core 14 to be rapidly undermined and liberated from the particle compact at the interface with the wellbore fluid, such that the effective rate of dissolution of particle compacts made using particle cores 14 of these core materials 18 is high, even though core material 18 itself may have a low dissolution rate, including core materials 20 that may be substantially insoluble in the wellbore fluid.

With regard to the electrochemically active metals as core materials 18, including Mg, Al, Mn or Zn, these metals may be used as pure metals or in any combination with one another, including various alloy combinations of these materials, including binary, tertiary, or quaternary alloys of these materials. These combinations may also include composites of these materials. Further, in addition to combinations with one another, the Mg, Al, Mn or Zn core materials 18 may also include other constituents, including various alloying additions, to alter one or more properties of the particle cores 14, such as by improving the strength, lowering the density or altering the dissolution characteristics of the core material 18.

Among the electrochemically active metals, Mg, either as a pure metal or an alloy or a composite material, is particularly useful, because of its low density and ability to form high-strength alloys, as well as its high degree of electrochemical activity, since it has a standard oxidation potential higher than Al, Mn or Zn. Mg alloys include all alloys that have Mg as an alloy constituent. Mg alloys that combine other electrochemically active metals, as described herein, as alloy constituents are particularly useful, including binary Mg—Zn, Mg—Al and Mg—Mn alloys, as well as tertiary Mg—Zn—Y and Mg—Al—X alloys, where X includes Zn, Mn, Si, Ca or Y, or a combination thereof. These Mg—Al—X alloys may include, by weight, up to about 85% Mg, up to about 15% Al and up to about 5% X. Particle core 14 and core material 18, and particularly electrochemically active metals including Mg, Al, Mn or Zn, or combinations thereof, may also include a rare earth element or combination of rare earth elements. As used herein, rare earth elements include Sc, Y, La, Ce, Pr, Nd or Er, or a combination of rare earth elements. Where present, a rare earth element or combinations of rare earth elements may be present, by weight, in an amount of about 5% or less.

Particle core 14 and core material 18 have a melting temperature ($T_P$). As used herein, $T_P$ includes the lowest temperature at which incipient melting or liquation or other forms of partial melting occur within core material 18, regardless of whether core material 18 comprises a pure metal, an alloy with multiple phases having different melting temperatures or a composite of materials having different melting temperatures.

Figure 6:
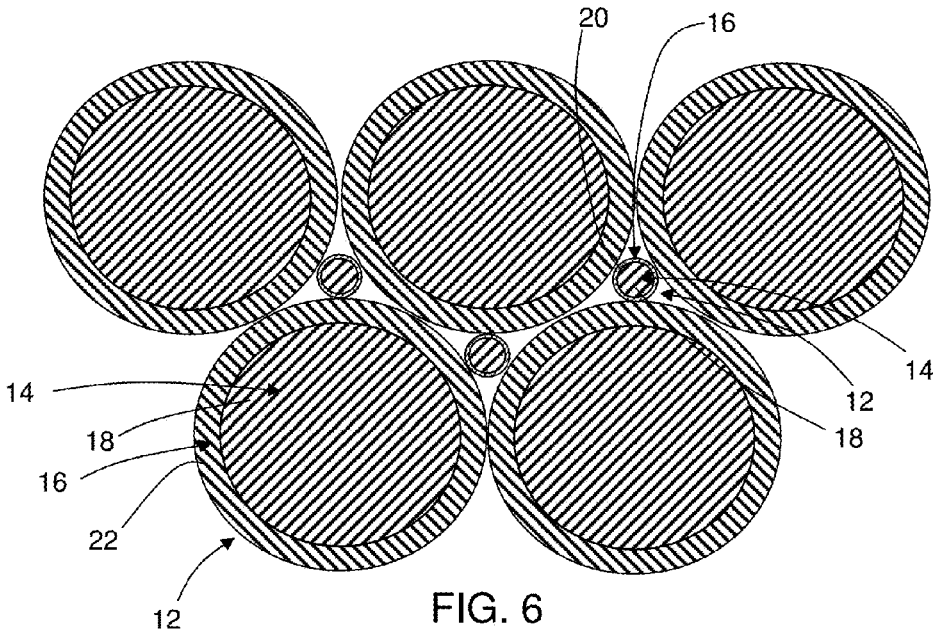
FIG. 6 is a schematic illustration of a second exemplary embodiment of a powder as disclosed herein having a multi-modal distribution of particle sizes.

Particle cores 14 may have any suitable particle size or range of particle sizes or distribution of particle sizes. For example, the particle cores 14 may be selected to provide an average particle size that is represented by a normal or Gaussian type unimodal distribution around an average or mean, as illustrated generally in FIG. 1. In another example, particle cores 14 may be selected or mixed to provide a multimodal distribution of particle sizes, including a plurality of average particle core sizes, such as, for example, a homogeneous bimodal distribution of average particle sizes, as illustrated generally and schematically in FIG. 6. The selection of the distribution of particle core size may be used to determine, for example, the particle size and interparticle spacing 15 of the particles 12 of powder 10. In an exemplary embodiment, the particle cores 14 may have a unimodal distribution and an average particle diameter of about 5 μm to about 300 μm, more particularly about 80 μm to about 120 μm, and even more particularly about 100 μm.

Particle cores 14 may have any suitable particle shape, including any regular or irregular geometric shape, or combination thereof. In an exemplary embodiment, particle cores 14 are substantially spheroidal electrochemically active metal particles. In another exemplary embodiment, particle cores 14 are substantially irregularly shaped ceramic particles. In yet another exemplary embodiment, particle cores 14 are carbon or other nanotube structures or hollow glass microspheres.

Figure 2:
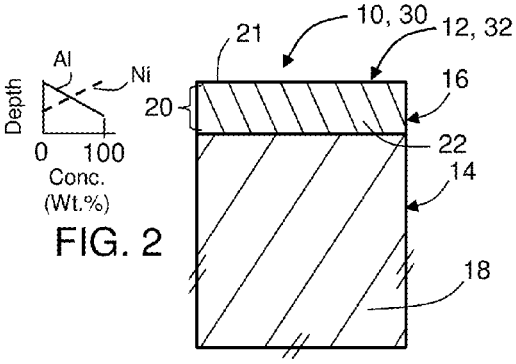
FIG. 2 is a schematic illustration of an exemplary embodiment of a powder particle 12 as it would appear in an exemplary section view represented by section 2-2 of FIG. 1.
Figure 3:
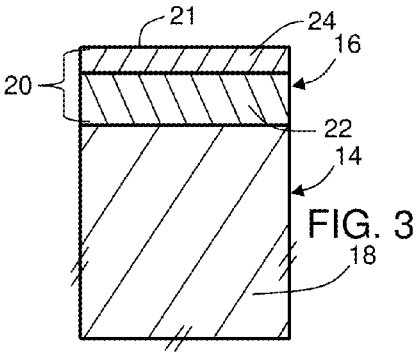
FIG. 3 is a schematic illustration of a second exemplary embodiment of a powder particle 12 as it would appear in a second exemplary section view represented by section 2-2 of FIG. 1.
Figure 4:
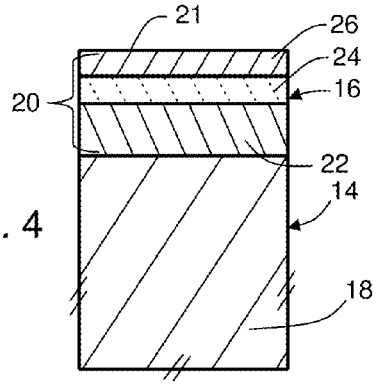
FIG. 4 is a schematic illustration of a third exemplary embodiment of a powder particle 12 as it would appear in a third exemplary section view represented by section 2-2 of FIG. 1.
Figure 5:
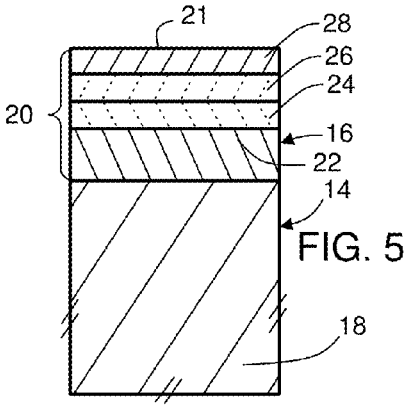
FIG. 5 is a schematic illustration of a fourth exemplary embodiment of a powder particle 12 as it would appear in a fourth exemplary section view represented by section 2-2 of FIG. 1.

Each of the metallic, coated powder particles 12 of powder 10 also includes a metallic coating layer 16 that is disposed on particle core 14. Metallic coating layer 16 includes a metallic coating material 20. Metallic coating material 20 gives the powder particles 12 and powder 10 its metallic nature. Metallic coating layer 16 is a nanoscale coating layer. In an exemplary embodiment, metallic coating layer 16 may have a thickness of about 25 nm to about 2500 nm. The thickness of metallic coating layer 16 may vary over the surface of particle core 14, but will preferably have a substantially uniform thickness over the surface of particle core 14. Metallic coating layer 16 may include a single layer, as illustrated in FIG. 2, or a plurality of layers as a multilayer coating structure, as illustrated in FIGS. 3-5 for up to four layers. In a single layer coating, or in each of the layers of a multilayer coating, the metallic coating layer 16 may include a single constituent chemical element or compound, or may include a plurality of chemical elements or compounds. Where a layer includes a plurality of chemical constituents or compounds, they may have all manner of homogeneous or heterogeneous distributions, including a homogeneous or heterogeneous distribution of metallurgical phases. This may include a graded distribution where the relative amounts of the chemical constituents or compounds vary according to respective constituent profiles across the thickness of the layer. In both single layer and multilayer coatings 16, each of the respective layers, or combinations of them, may be used to provide a predetermined property to the powder particle 12 or a sintered powder compact formed therefrom. For example, the predetermined property may include the bond strength of the metallurgical bond between the particle core 14 and the coating material 20; the interdiffusion characteristics between the particle core 14 and metallic coating layer 16, including any interdiffusion between the layers of a multilayer coating layer 16; the interdiffusion characteristics between the various layers of a multilayer coating layer 16; the interdiffusion characteristics between the metallic coating layer 16 of one powder particle and that of an adjacent powder particle 12; the bond strength of the metallurgical bond between the metallic coating layers of adjacent sintered powder particles 12, including the outermost layers of multilayer coating layers; and the electrochemical activity of the coating layer 16.

Metallic coating layer 16 and coating material 20 have a melting temperature ($T_C$). As used herein, $T_C$ includes the lowest temperature at which incipient melting or liquation or other forms of partial melting occur within coating material 20, regardless of whether coating material 20 comprises a pure metal, an alloy with multiple phases each having different melting temperatures or a composite, including a composite comprising a plurality of coating material layers having different melting temperatures.

Metallic coating material 20 may include any suitable metallic coating material 20 that provides a sinterable outer surface 21 that is configured to be sintered to an adjacent powder particle 12 that also has a metallic coating layer 16 and sinterable outer surface 21. In powders 10 that also include second or additional (coated or uncoated) particles 32, as described herein, the sinterable outer surface 21 of metallic coating layer 16 is also configured to be sintered to a sinterable outer surface 21 of second particles 32. In an exemplary embodiment, the powder particles 12 are sinterable at a predetermined sintering temperature ($T_S$) that is a function of the core material 18 and coating material 20, such that sintering of powder compact 200 is accomplished entirely in the solid state and where $T_S$ is less than $T_P$ and $T_C$. Sintering in the solid state limits particle core 14/metallic coating layer 16 interactions to solid state diffusion processes and metallurgical transport phenomena and limits growth of and provides control over the resultant interface between them. In contrast, for example, the introduction of liquid phase sintering would provide for rapid interdiffusion of the particle core 14/metallic coating layer 16 materials and make it difficult to limit the growth of and provide control over the resultant interface between them, and thus interfere with the formation of the desirable microstructure of particle compact 200 as described herein.

In an exemplary embodiment, core material 18 will be selected to provide a core chemical composition and the coating material 20 will be selected to provide a coating chemical composition and these chemical compositions will also be selected to differ from one another. In another exemplary embodiment, the core material 18 will be selected to provide a core chemical composition and the coating material 20 will be selected to provide a coating chemical composition and these chemical compositions will also be selected to differ from one another at their interface. Differences in the chemical compositions of coating material 20 and core material 18 may be selected to provide different dissolution rates and selectable and controllable dissolution of powder compacts 200 that incorporate them making them selectably and controllably dissolvable. This includes dissolution rates that differ in response to a changed condition in the wellbore, including an indirect or direct change in a wellbore fluid. In an exemplary embodiment, a powder compact 200 formed from powder 10 having chemical compositions of core material 18 and coating material 20 that make compact 200 is selectably dissolvable in a wellbore fluid in response to a changed wellbore condition that includes a change in temperature, change in pressure, change in flow rate, change in pH or change in chemical composition of the wellbore fluid, or a combination thereof. The selectable dissolution response to the changed condition may result from actual chemical reactions or processes that promote different rates of dissolution, but also encompass changes in the dissolution response that are associated with physical reactions or processes, such as changes in wellbore fluid pressure or flow rate.

In an exemplary embodiment of a powder 10, particle core 14 includes Mg, Al, Mn or Zn, or a combination thereof, as core material 18, and more particularly may include pure Mg and Mg alloys, and metallic coating layer 16 includes Al, Zn, Mn, Mg, Mo, W, Cu, Fe, Si, Ca, Co, Ta, Re, or Ni, or an oxide, nitride or a carbide thereof, or a combination of any of the aforementioned materials as coating material 20.

In another exemplary embodiment of powder 10, particle core 14 includes Mg, Al, Mn or Zn, or a combination thereof, as core material 18, and more particularly may include pure Mg and Mg alloys, and metallic coating layer 16 includes a single layer of Al or Ni, or a combination thereof, as coating material 20, as illustrated in FIG. 2. Where metallic coating layer 16 includes a combination of two or more constituents, such as Al and Ni, the combination may include various graded or co-deposited structures of these materials where the amount of each constituent, and hence the composition of the layer, varies across the thickness of the layer, as also illustrated in FIG. 2.

In yet another exemplary embodiment, particle core 14 includes Mg, Al, Mn or Zn, or a combination thereof, as core material 18, and more particularly may include pure Mg and Mg alloys, and coating layer 16 includes two layers as core material 20, as illustrated in FIG. 3. The first layer 22 is disposed on the surface of particle core 14 and includes Al or Ni, or a combination thereof, as described herein. The second layer 24 is disposed on the surface of the first layer and includes Al, Zn, Mg, Mo, W, Cu, Fe, Si, Ca, Co, Ta, Re or Ni, or a combination thereof, and the first layer has a chemical composition that is different than the chemical composition of the second layer. In general, first layer 22 will be selected to provide a strong metallurgical bond to particle core 14 and to limit interdiffusion between the particle core 14 and coating layer 16, particularly first layer 22. Second layer 24 may be selected to increase the strength of the metallic coating layer 16, or to provide a strong metallurgical bond and promote sintering with the second layer 24 of adjacent powder particles 12, or both. In an exemplary embodiment, the respective layers of metallic coating layer 16 may be selected to promote the selective and controllable dissolution of the coating layer 16 in response to a change in a property of the wellbore, including the wellbore fluid, as described herein. However, this is only exemplary and it will be appreciated that other selection criteria for the various layers may also be employed. For example, any of the respective layers may be selected to promote the selective and controllable dissolution of the coating layer 16 in response to a change in a property of the wellbore, including the wellbore fluid, as described herein. Exemplary embodiments of a two-layer metallic coating layers 16 for use on particles cores 14 comprising Mg include first/second layer combinations comprising Al/Ni and Al/W.

In still another embodiment, particle core 14 includes Mg, Al, Mn or Zn, or a combination thereof, as core material 18, and more particularly may include pure Mg and Mg alloys, and coating layer 16 includes three layers, as illustrated in FIG. 4. The first layer 22 is disposed on particle core 14 and may include Al or Ni, or a combination thereof. The second layer 24 is disposed on first layer 22 and may include Al, Zn, Mg, Mo, W, Cu, Fe, Si, Ca, Co, Ta, Re or Ni, or an oxide, nitride or a carbide thereof, or a combination of any of the aforementioned second layer materials. The third layer 26 is disposed on the second layer 24 and may include Al, Mn, Fe, Co, Ni or a combination thereof. In a three-layer configuration, the composition of adjacent layers is different, such that the first layer has a chemical composition that is different than the second layer, and the second layer has a chemical composition that is different than the third layer. In an exemplary embodiment, first layer 22 may be selected to provide a strong metallurgical bond to particle core 14 and to limit interdiffusion between the particle core 14 and coating layer 16, particularly first layer 22. Second layer 24 may be selected to increase the strength of the metallic coating layer 16, or to limit interdiffusion between particle core 14 or first layer 22 and outer or third layer 26, or to promote adhesion and a strong metallurgical bond between third layer 26 and first layer 22, or any combination of them. Third layer 26 may be selected to provide a strong metallurgical bond and promote sintering with the third layer 26 of adjacent powder particles 12. However, this is only exemplary and it will be appreciated that other selection criteria for the various layers may also be employed. For example, any of the respective layers may be selected to promote the selective and controllable dissolution of the coating layer 16 in response to a change in a property of the wellbore, including the wellbore fluid, as described herein. An exemplary embodiment of a three-layer coating layer for use on particles cores comprising Mg include first/second/third layer combinations comprising $Al/Al_2O_3/Al$.

In still another embodiment, particle core 14 includes Mg, Al, Mn or Zn, or a combination thereof, as core material 18, and more particularly may include pure Mg and Mg alloys, and coating layer 16 includes four layers, as illustrated in FIG. 5. In the four layer configuration, the first layer 22 may include Al or Ni, or a combination thereof, as described herein. The second layer 24 may include Al, Zn, Mg, Mo, W, Cu, Fe, Si, Ca, Co, Ta, Re or Ni or an oxide, nitride, carbide thereof, or a combination of the aforementioned second layer materials. The third layer 26 may also include Al, Zn, Mg, Mo, W, Cu, Fe, Si, Ca, Co, Ta, Re or Ni, or an oxide, nitride or carbide thereof, or a combination of any of the aforementioned third layer materials. The fourth layer 28 may include Al, Mn, Fe, Co, Ni or a combination thereof. In the four layer configuration, the chemical composition of adjacent layers is different, such that the chemical composition of first layer 22 is different than the chemical composition of second layer 24, the chemical composition is of second layer 24 different than the chemical composition of third layer 26, and the chemical composition of third layer 26 is different than the chemical composition of fourth layer 28. In an exemplary embodiment, the selection of the various layers will be similar to that described for the three-layer configuration above with regard to the inner (first) and outer (fourth) layers, with the second and third layers available for providing enhanced interlayer adhesion, strength of the overall metallic coating layer 16, limited interlayer diffusion or selectable and controllable dissolution, or a combination thereof. However, this is only exemplary and it will be appreciated that other selection criteria for the various layers may also be employed. For example, any of the respective layers may be selected to promote the selective and controllable dissolution of the coating layer 16 in response to a change in a property of the wellbore, including the wellbore fluid, as described herein.

The thickness of the various layers in multi-layer configurations may be apportioned between the various layers in any manner so long as the sum of the layer thicknesses provide a nanoscale coating layer 16, including layer thicknesses as described herein. In one embodiment, the first layer 22 and outer layer (24, 26, or 28 depending on the number of layers) may be thicker than other layers, where present, due to the desire to provide sufficient material to promote the desired bonding of first layer 22 with the particle core 14, or the bonding of the outer layers of adjacent powder particles 12, during sintering of powder compact 200.

Figure 7:
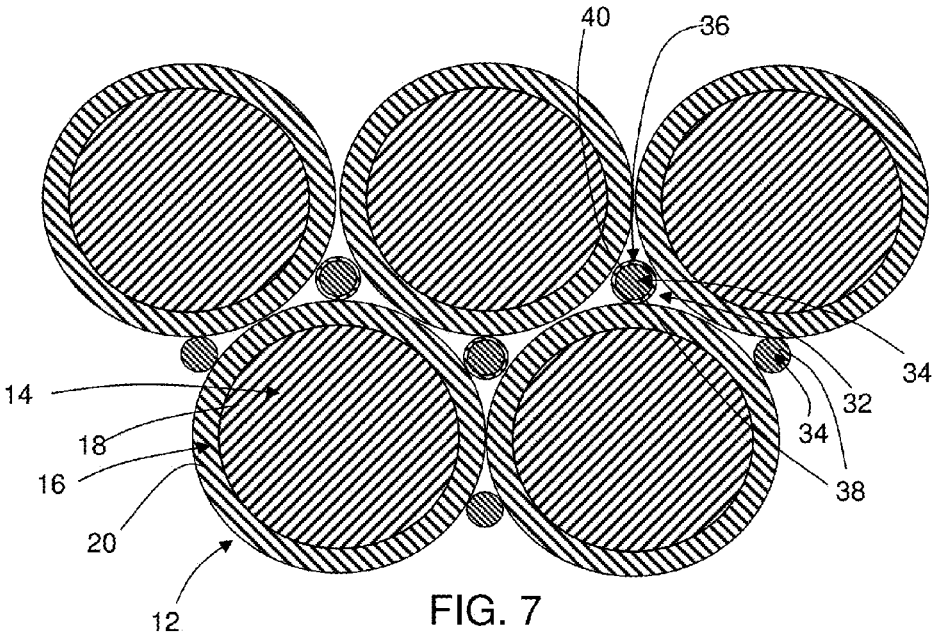
FIG. 7 is a schematic illustration of a third exemplary embodiment of a powder as disclosed herein having a multi-modal distribution of particle sizes.

Powder 10 may also include an additional or second powder 30 interspersed in the plurality of powder particles 12, as illustrated in FIG. 7. In an exemplary embodiment, the second powder 30 includes a plurality of second powder particles 32. These second powder particles 32 may be selected to change a physical, chemical, mechanical or other property of a powder particle compact 200 formed from powder 10 and second powder 30, or a combination of such properties. In an exemplary embodiment, the property change may include an increase in the compressive strength of powder compact 200 formed from powder 10 and second powder 30. In another exemplary embodiment, the second powder 30 may be selected to promote the selective and controllable dissolution of in particle compact 200 formed from powder 10 and second powder 30 in response to a change in a property of the wellbore, including the wellbore fluid, as described herein. Second powder particles 32 may be uncoated or coated with a metallic coating layer 36. When coated, including single layer or multilayer coatings, the coating layer 36 of second powder particles 32 may comprise the same coating material 40 as coating material 20 of powder particles 12, or the coating material 40 may be different. The second powder particles 32 (uncoated) or particle cores 34 may include any suitable material to provide the desired benefit, including many metals. In an exemplary embodiment, when coated powder particles 12 comprising Mg, Al, Mn or Zn, or a combination thereof are employed, suitable second powder particles 32 may include Ni, W, Cu, Co or Fe, or a combination thereof. Since second powder particles 32 will also be configured for solid state sintering to powder particles 12 at the predetermined sintering temperature ($T_S$), particle cores 34 will have a melting temperature $T_{AP}$ and any coating layers 36 will have a second melting temperature $T_{AC}$, where $T_S$ is less than $T_{AP}$ and $T_{AC}$. It will also be appreciated that second powder 30 is not limited to one additional powder particle 32 type (i.e., a second powder particle), but may include a plurality of additional powder particles 32 (i.e., second, third, fourth, etc. types of additional powder particles 32) in any number.

Figure 8:
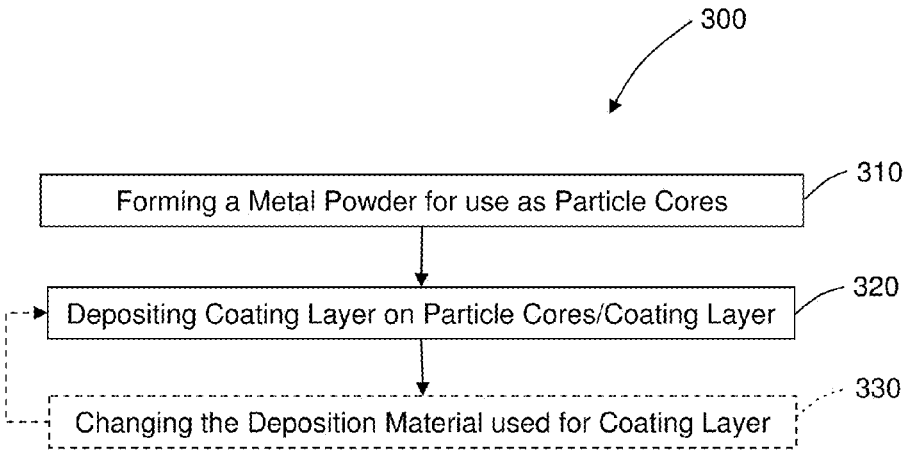
FIG. 8 is a flow chart of an exemplary embodiment of a method of making a powder as disclosed herein.

Referring to FIG. 8, an exemplary embodiment of a method 300 of making a metallic powder 10 is disclosed. Method 300 includes forming 310 a plurality of particle cores 14 as described herein. Method 300 also includes depositing 320 a metallic coating layer 16 on each of the plurality of particle cores 14. Depositing 320 is the process by which coating layer 16 is disposed on particle core 14 as described herein.

Forming 310 of particle cores 14 may be performed by any suitable method for forming a plurality of particle cores 14 of the desired core material 18, which essentially comprise methods of forming a powder of core material 18. Suitable powder forming methods include mechanical methods; including machining, milling, impacting and other mechanical methods for forming the metal powder; chemical methods, including chemical decomposition, precipitation from a liquid or gas, solid-solid reactive synthesis and other chemical powder forming methods; atomization methods, including gas atomization, liquid and water atomization, centrifugal atomization, plasma atomization and other atomization methods for forming a powder; and various evaporation and condensation methods. In an exemplary embodiment, particle cores 14 comprising Mg may be fabricated using an atomization method, such as vacuum spray forming or inert gas spray forming.

Depositing 320 of metallic coating layers 16 on the plurality of particle cores 14 may be performed using any suitable deposition method, including various thin film deposition methods, such as, for example, chemical vapor deposition and physical vapor deposition methods. In an exemplary embodiment, depositing 320 of metallic coating layers 16 is performed using fluidized bed chemical vapor deposition (FBCVD). Depositing 320 of the metallic coating layers 16 by FBCVD includes flowing a reactive fluid as a coating medium that includes the desired metallic coating material 20 through a bed of particle cores 14 fluidized in a reactor vessel under suitable conditions, including temperature, pressure and flow rate conditions and the like, sufficient to induce a chemical reaction of the coating medium to produce the desired metallic coating material 20 and induce its deposition upon the surface of particle cores 14 to form coated powder particles 12. The reactive fluid selected will depend upon the metallic coating material 20 desired, and will typically comprise an organometallic compound that includes the metallic material to be deposited, such as nickel tetracarbonyl ($Ni(CO)_4$), tungsten hexafluoride ($WF_6$), and triethyl aluminum ($C_6H_{15}Al$), that is transported in a carrier fluid, such as helium or argon gas. The reactive fluid, including carrier fluid, causes at least a portion of the plurality of particle cores 14 to be suspended in the fluid, thereby enabling the entire surface of the suspended particle cores 14 to be exposed to the reactive fluid, including, for example, a desired organometallic constituent, and enabling deposition of metallic coating material 20 and coating layer 16 over the entire surfaces of particle cores 14 such that they each become enclosed forming coated particles 12 having metallic coating layers 16, as described herein. As also described herein, each metallic coating layer 16 may include a plurality of coating layers. Coating material 20 may be deposited in multiple layers to form a multilayer metallic coating layer 16 by repeating the step of depositing 320 described above and changing 330 the reactive fluid to provide the desired metallic coating material 20 for each subsequent layer, where each subsequent layer is deposited on the outer surface of particle cores 14 that already include any previously deposited coating layer or layers that make up metallic coating layer 16. The metallic coating materials 20 of the respective layers (e.g., 22, 24, 26, 28, etc.) may be different from one another, and the differences may be provided by utilization of different reactive media that are configured to produce the desired metallic coating layers 16 on the particle cores 14 in the fluidize bed reactor.

Figure 9:
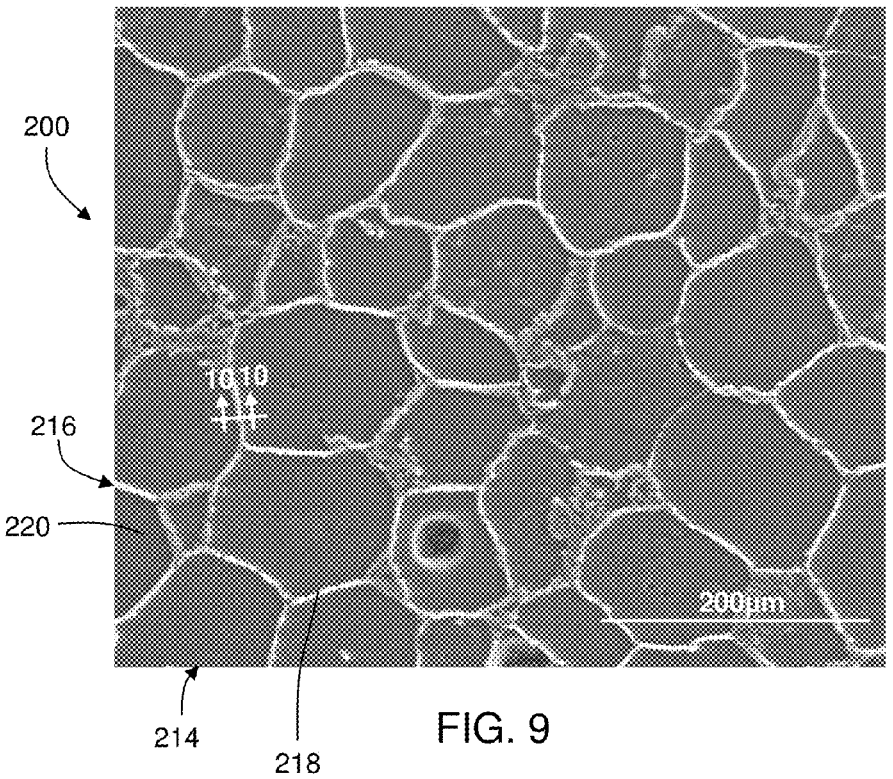
FIG. 9 is a photomicrograph of an exemplary embodiment of a powder compact as disclosed herein.

As illustrated in FIGS. 1 and 9, particle core 14 and core material 18 and metallic coating layer 16 and coating material 20 may be selected to provide powder particles 12 and a powder 10 that is configured for compaction and sintering to provide a powder compact 200 that is lightweight (i.e., having a relatively low density), high-strength and is selectably and controllably removable from a wellbore in response to a change in a wellbore property, including being selectably and controllably dissolvable in an appropriate wellbore fluid, including various wellbore fluids as disclosed herein. Powder compact 200 includes a substantially-continuous, cellular nanomatrix 216 of a nanomatrix material 220 having a plurality of dispersed particles 214 dispersed throughout the cellular nanomatrix 216. The substantially-continuous cellular nanomatrix 216 and nanomatrix material 220 formed of sintered metallic coating layers 16 is formed by the compaction and sintering of the plurality of metallic coating layers 16 of the plurality of powder particles 12. The chemical composition of nanomatrix material 220 may be different than that of coating material 20 due to diffusion effects associated with the sintering as described herein. Powder metal compact 200 also includes a plurality of dispersed particles 214 that comprise particle core material 218. Dispersed particle cores 214 and core material 218 correspond to and are formed from the plurality of particle cores 14 and core material 18 of the plurality of powder particles 12 as the metallic coating layers 16 are sintered together to form nanomatrix 216. The chemical composition of core material 218 may be different than that of core material 18 due to diffusion effects associated with sintering as described herein.

As used herein, the use of the term substantially-continuous cellular nanomatrix 216 does not connote the major constituent of the powder compact, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 220 within powder compact 200. As used herein, "substantially-continuous" describes the extension of the nanomatrix material throughout powder compact 200 such that it extends between and envelopes substantially all of the dispersed particles 214. Substantially-continuous is used to indicate that complete continuity and regular order of the nanomatrix around each dispersed particle 214 is not required. For example, defects in the coating layer 16 over particle core 14 on some powder particles 12 may cause bridging of the particle cores 14 during sintering of the powder compact 200, thereby causing localized discontinuities to result within the cellular nanomatrix 216, even though in the other portions of the powder compact the nanomatrix is substantially continuous and exhibits the structure described herein. As used herein, "cellular" is used to indicate that the nanomatrix defines a network of generally repeating, interconnected, compartments or cells of nanomatrix material 220 that encompass and also interconnect the dispersed particles 214. As used herein, "nanomatrix" is used to describe the size or scale of the matrix, particularly the thickness of the matrix between adjacent dispersed particles 214. The metallic coating layers that are sintered together to form the nanomatrix are themselves nanoscale thickness coating layers. Since the nanomatrix at most locations, other than the intersection of more than two dispersed particles 214, generally comprises the interdiffusion and bonding of two coating layers 16 from adjacent powder particles 12 having nanoscale thicknesses, the matrix formed also has a nanoscale thickness (e.g., approximately two times the coating layer thickness as described herein) and is thus described as a nanomatrix. Further, the use of the term dispersed particles 214 does not connote the minor constituent of powder compact 200, but rather refers to the majority constituent or constituents, whether by weight or by volume. The use of the term dispersed particle is intended to convey the discontinuous and discrete distribution of particle core material 218 within powder compact 200.

Powder compact 200 may have any desired shape or size, including that of a cylindrical billet or bar that may be machined or otherwise used to form useful articles of manufacture, including various wellbore tools and components. The pressing used to form precursor powder compact 100 and sintering and pressing processes used to form powder compact 200 and deform the powder particles 12, including particle cores 14 and coating layers 16, to provide the full density and desired macroscopic shape and size of powder compact 200 as well as its microstructure. The microstructure of powder compact 200 includes an equiaxed configuration of dispersed particles 214 that are dispersed throughout and embedded within the substantially-continuous, cellular nanomatrix 216 of sintered coating layers. This microstructure is somewhat analogous to an equiaxed grain microstructure with a continuous grain boundary phase, except that it does not require the use of alloy constituents having thermodynamic phase equilibria properties that are capable of producing such a structure. Rather, this equiaxed dispersed particle structure and cellular nanomatrix 216 of sintered metallic coating layers 16 may be produced using constituents where thermodynamic phase equilibrium conditions would not produce an equiaxed structure. The equiaxed morphology of the dispersed particles 214 and cellular network 216 of particle layers results from sintering and deformation of the powder particles 12 as they are compacted and interdiffuse and deform to fill the interparticle spaces 15 (FIG. 1). The sintering temperatures and pressures may be selected to ensure that the density of powder compact 200 achieves substantially full theoretical density.

Figure 10:
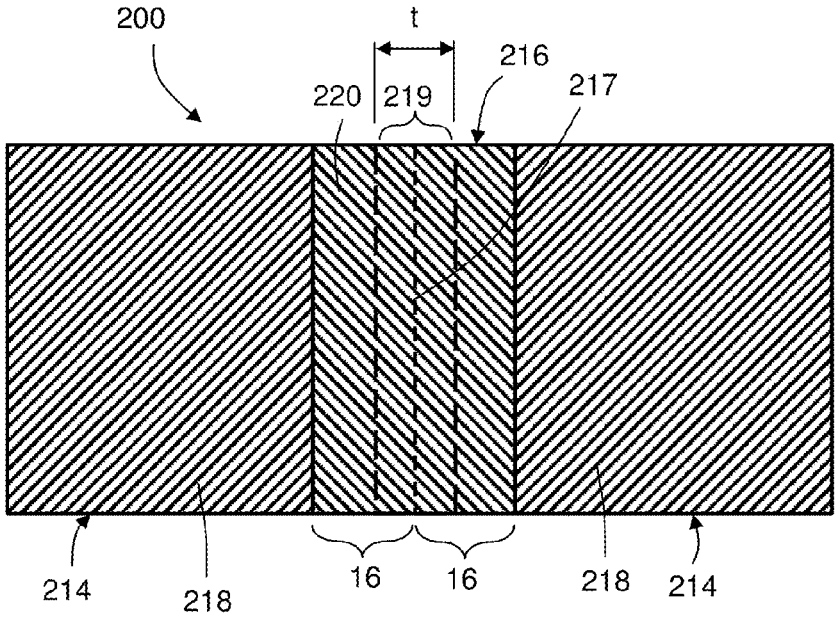
FIG. 10 is a schematic of illustration of an exemplary embodiment of the powder compact of FIG. 9 made using a powder having single-layer coated powder particles as it would appear taken along section 10-10.

In an exemplary embodiment as illustrated in FIGS. 1 and 9, dispersed particles 214 are formed from particle cores 14 dispersed in the cellular nanomatrix 216 of sintered metallic coating layers 16, and the nanomatrix 216 includes a solid-state metallurgical bond 217 or bond layer 219, as illustrated schematically in FIG. 10, extending between the dispersed particles 214 throughout the cellular nanomatrix 216 that is formed at a sintering temperature ($T_S$), where $T_S$ is less than $T_C$ and $T_P$. As indicated, solid-state metallurgical bond 217 is formed in the solid state by solid-state interdiffusion between the coating layers 16 of adjacent powder particles 12 that are compressed into touching contact during the compaction and sintering processes used to form powder compact 200, as described herein. As such, sintered coating layers 16 of cellular nanomatrix 216 include a solid-state bond layer 219 that has a thickness (t) defined by the extent of the interdiffusion of the coating materials 20 of the coating layers 16, which will in turn be defined by the nature of the coating layers 16, including whether they are single or multilayer coating layers, whether they have been selected to promote or limit such interdiffusion, and other factors, as described herein, as well as the sintering and compaction conditions, including the sintering time, temperature and pressure used to form powder compact 200.

As nanomatrix 216 is formed, including bond 217 and bond layer 219, the chemical composition or phase distribution, or both, of metallic coating layers 16 may change. Nanomatrix 216 also has a melting temperature ($T_M$). As used herein, $T_M$ includes the lowest temperature at which incipient melting or liquation or other forms of partial melting will occur within nanomatrix 216, regardless of whether nanomatrix material 220 comprises a pure metal, an alloy with multiple phases each having different melting temperatures or a composite, including a composite comprising a plurality of layers of various coating materials having different melting temperatures, or a combination thereof, or otherwise. As dispersed particles 214 and particle core materials 218 are formed in conjunction with nanomatrix 216, diffusion of constituents of metallic coating layers 16 into the particle cores 14 is also possible, which may result in changes in the chemical composition or phase distribution, or both, of particle cores 14. As a result, dispersed particles 214 and particle core materials 218 may have a melting temperature ($T_{DP}$) that is different than $T_P$. As used herein, $T_{DP}$ includes the lowest temperature at which incipient melting or liquation or other forms of partial melting will occur within dispersed particles 214, regardless of whether particle core material 218 comprise a pure metal, an alloy with multiple phases each having different melting temperatures or a composite, or otherwise. Powder compact 200 is formed at a sintering temperature ($T_S$), where $T_S$ is less than $T_C$, $T_P$, $T_M$ and $T_{DP}$.

Dispersed particles 214 may comprise any of the materials described herein for particle cores 14, even though the chemical composition of dispersed particles 214 may be different due to diffusion effects as described herein. In an exemplary embodiment, dispersed particles 214 are formed from particle cores 14 comprising materials having a standard oxidation potential greater than or equal to Zn, including Mg, Al, Zn or Mn, or a combination thereof, may include various binary, tertiary and quaternary alloys or other combinations of these constituents as disclosed herein in conjunction with particle cores 14. Of these materials, those having dispersed particles 214 comprising Mg and the nanomatrix 216 formed from the metallic coating materials 16 described herein are particularly useful. Dispersed particles 214 and particle core material 218 of Mg, Al, Zn or Mn, or a combination thereof, may also include a rare earth element, or a combination of rare earth elements as disclosed herein in conjunction with particle cores 14.

In another exemplary embodiment, dispersed particles 214 are formed from particle cores 14 comprising metals that are less electrochemically active than Zn or non-metallic materials. Suitable non-metallic materials include ceramics, glasses (e.g., hollow glass microspheres) or carbon, or a combination thereof, as described herein.

Dispersed particles 214 of powder compact 200 may have any suitable particle size, including the average particle sizes described herein for particle cores 14.

Dispersed particles 214 may have any suitable shape depending on the shape selected for particle cores 14 and powder particles 12, as well as the method used to sinter and compact powder 10. In an exemplary embodiment, powder particles 12 may be spheroidal or substantially spheroidal and dispersed particles 214 may include an equiaxed particle configuration as described herein.

The nature of the dispersion of dispersed particles 214 may be affected by the selection of the powder 10 or powders 10 used to make particle compact 200. In one exemplary embodiment, a powder 10 having a unimodal distribution of powder particle 12 sizes may be selected to form powder compact 200 and will produce a substantially homogeneous unimodal dispersion of particle sizes of dispersed particles 214 within cellular nanomatrix 216, as illustrated generally in FIG. 9. In another exemplary embodiment, a plurality of powders 10 having a plurality of powder particles with particle cores 14 that have the same core materials 18 and different core sizes and the same coating material 20 may be selected and uniformly mixed as described herein to provide a powder 10 having a homogenous, multimodal distribution of powder particle 12 sizes, and may be used to form powder compact 200 having a homogeneous, multimodal dispersion of particle sizes of dispersed particles 214 within cellular nanomatrix 216, as illustrated schematically in FIGS. 6 and 11. Similarly, in yet another exemplary embodiment, a plurality of powders 10 having a plurality of particle cores 14 that may have the same core materials 18 and different core sizes and the same coating material 20 may be selected and distributed in a non-uniform manner to provide a non-homogenous, multimodal distribution of powder particle sizes, and may be used to form powder compact 200 having a non-homogeneous, multimodal dispersion of particle sizes of dispersed particles 214 within cellular nanomatrix 216, as illustrated schematically in FIG. 12. The selection of the distribution of particle core size may be used to determine, for example, the particle size and interparticle spacing of the dispersed particles 214 within the cellular nanomatrix 216 of powder compacts 200 made from powder 10.

Figure 13:
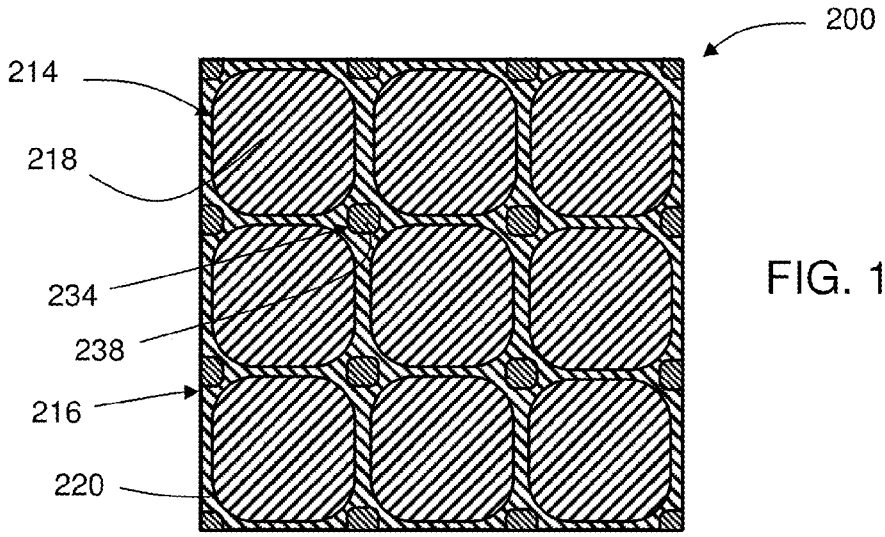
FIG. 13 is a schematic illustration of an exemplary embodiment of a powder compact as disclosed herein formed from a first powder and a second powder and having a homogenous multi-modal distribution of particle sizes.
Figure 14:
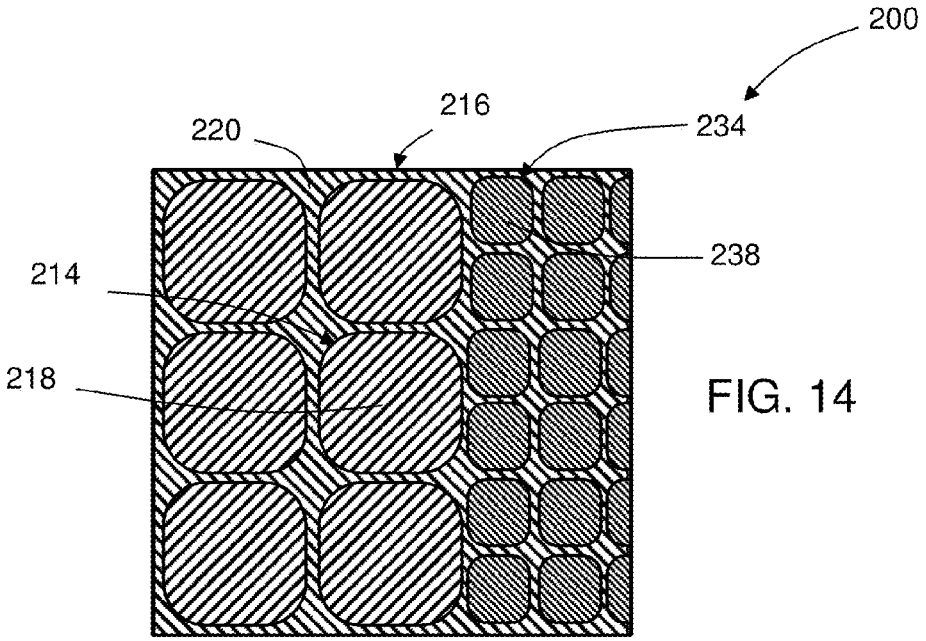
FIG. 14 is a schematic illustration of an exemplary embodiment of a powder compact as disclosed herein formed from a first powder and a second powder and having a non-homogeneous multi-modal distribution of particle sizes.

As illustrated generally in FIGS. 7 and 13, powder metal compact 200 may also be formed using coated metallic powder 10 and an additional or second powder 30, as described herein. The use of an additional powder 30 provides a powder compact 200 that also includes a plurality of dispersed second particles 234, as described herein, that are dispersed within the nanomatrix 216 and are also dispersed with respect to the dispersed particles 214. Dispersed second particles 234 may be formed from coated or uncoated second powder particles 32, as described herein. In an exemplary embodiment, coated second powder particles 32 may be coated with a coating layer 36 that is the same as coating layer 16 of powder particles 12, such that coating layers 36 also contribute to the nanomatrix 216. In another exemplary embodiment, the second powder particles 232 may be uncoated such that dispersed second particles 234 are embedded within nanomatrix 216. As disclosed herein, powder 10 and additional powder 30 may be mixed to form a homogeneous dispersion of dispersed particles 214 and dispersed second particles 234, as illustrated in FIG. 13, or to form a non-homogeneous dispersion of these particles, as illustrated in FIG. 14. The dispersed second particles 234 may be formed from any suitable additional powder 30 that is different from powder 10, either due to a compositional difference in the particle core 34, or coating layer 36, or both of them, and may include any of the materials disclosed herein for use as second powder 30 that are different from the powder 10 that is selected to form powder compact 200. In an exemplary embodiment, dispersed second particles 234 may include Fe, Ni, Co or Cu, or oxides, nitrides or carbides thereof, or a combination of any of the aforementioned materials.

Nanomatrix 216 is a substantially-continuous, cellular network of metallic coating layers 16 that are sintered to one another. The thickness of nanomatrix 216 will depend on the nature of the powder 10 or powders 10 used to form powder compact 200, as well as the incorporation of any second powder 30, particularly the thicknesses of the coating layers associated with these particles. In an exemplary embodiment, the thickness of nanomatrix 216 is substantially uniform throughout the microstructure of powder compact 200 and comprises about two times the thickness of the coating layers 16 of powder particles 12. In another exemplary embodiment, the cellular network 216 has a substantially uniform average thickness between dispersed particles 214 of about 50 nm to about 5000 nm.

Nanomatrix 216 is formed by sintering metallic coating layers 16 of adjacent particles to one another by interdiffusion and creation of bond layer 219 as described herein. Metallic coating layers 16 may be single layer or multilayer structures, and they may be selected to promote or inhibit diffusion, or both, within the layer or between the layers of metallic coating layer 16, or between the metallic coating layer 16 and particle core 14, or between the metallic coating layer 16 and the metallic coating layer 16 of an adjacent powder particle, the extent of interdiffusion of metallic coating layers 16 during sintering may be limited or extensive depending on the coating thicknesses, coating material or materials selected, the sintering conditions and other factors. Given the potential complexity of the interdiffusion and interaction of the constituents, description of the resulting chemical composition of nanomatrix 216 and nanomatrix material 220 may be simply understood to be a combination of the constituents of coating layers 16 that may also include one or more constituents of dispersed particles 214, depending on the extent of interdiffusion, if any, that occurs between the dispersed particles 214 and the nanomatrix 216. Similarly, the chemical composition of dispersed particles 214 and particle core material 218 may be simply understood to be a combination of the constituents of particle core 14 that may also include one or more constituents of nanomatrix 216 and nanomatrix material 220, depending on the extent of interdiffusion, if any, that occurs between the dispersed particles 214 and the nanomatrix 216.

In an exemplary embodiment, the nanomatrix material 220 has a chemical composition and the particle core material 218 has a chemical composition that is different from that of nanomatrix material 220, and the differences in the chemical compositions may be configured to provide a selectable and controllable dissolution rate, including a selectable transition from a very low dissolution rate to a very rapid dissolution rate, in response to a controlled change in a property or condition of the wellbore proximate the compact 200, including a property change in a wellbore fluid that is in contact with the powder compact 200, as described herein. Nanomatrix 216 may be formed from powder particles 12 having single layer and multilayer coating layers 16. This design flexibility provides a large number of material combinations, particularly in the case of multilayer coating layers 16, that can be utilized to tailor the cellular nanomatrix 216 and composition of nanomatrix material 220 by controlling the interaction of the coating layer constituents, both within a given layer, as well as between a coating layer 16 and the particle core 14 with which it is associated or a coating layer 16 of an adjacent powder particle 12. Several exemplary embodiments that demonstrate this flexibility are provided below.

As illustrated in FIG. 10, in an exemplary embodiment, powder compact 200 is formed from powder particles 12 where the coating layer 16 comprises a single layer, and the resulting nanomatrix 216 between adjacent ones of the plurality of dispersed particles 214 comprises the single metallic coating layer 16 of one powder particle 12, a bond layer 219 and the single coating layer 16 of another one of the adjacent powder particles 12. The thickness (t) of bond layer 219 is determined by the extent of the interdiffusion between the single metallic coating layers 16, and may encompass the entire thickness of nanomatrix 216 or only a portion thereof. In one exemplary embodiment of powder compact 200 formed using a single layer powder 10, powder compact 200 may include dispersed particles 214 comprising Mg, Al, Zn or Mn, or a combination thereof, as described herein, and nanomatrix 216 may include Al, Zn, Mn, Mg, Mo, W, Cu, Fe, Si, Ca, Co, Ta, Re or Ni, or an oxide, carbide or nitride thereof, or a combination of any of the aforementioned materials, including combinations where the nanomatrix material 220 of cellular nanomatrix 216, including bond layer 219, has a chemical composition and the core material 218 of dispersed particles 214 has a chemical composition that is different than the chemical composition of nanomatrix material 216. The difference in the chemical composition of the nanomatrix material 220 and the core material 218 may be used to provide selectable and controllable dissolution in response to a change in a property of a wellbore, including a wellbore fluid, as described herein. In a further exemplary embodiment of a powder compact 200 formed from a powder 10 having a single coating layer configuration, dispersed particles 214 include Mg, Al, Zn or Mn, or a combination thereof, and the cellular nanomatrix 216 includes Al or Ni, or a combination thereof.

Figure 15:
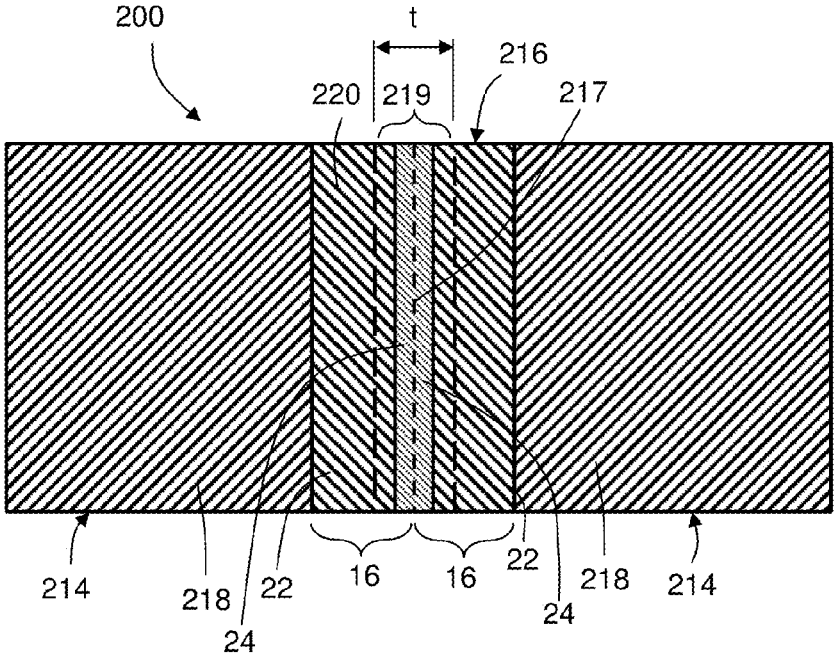
FIG. 15 is a schematic of illustration of another exemplary embodiment of the powder compact of FIG. 9 made using a powder having multilayer coated powder particles as it would appear taken along section 10-10.
Figure 11:
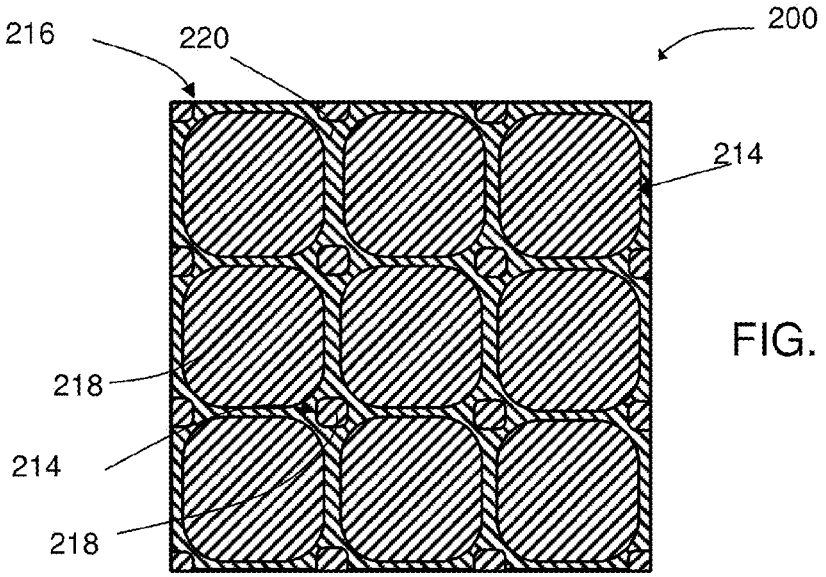
FIG. 11 is a schematic illustration of an exemplary embodiment of a powder compact as disclosed herein having a homogenous multi-modal distribution of particle sizes.
Figure 12:
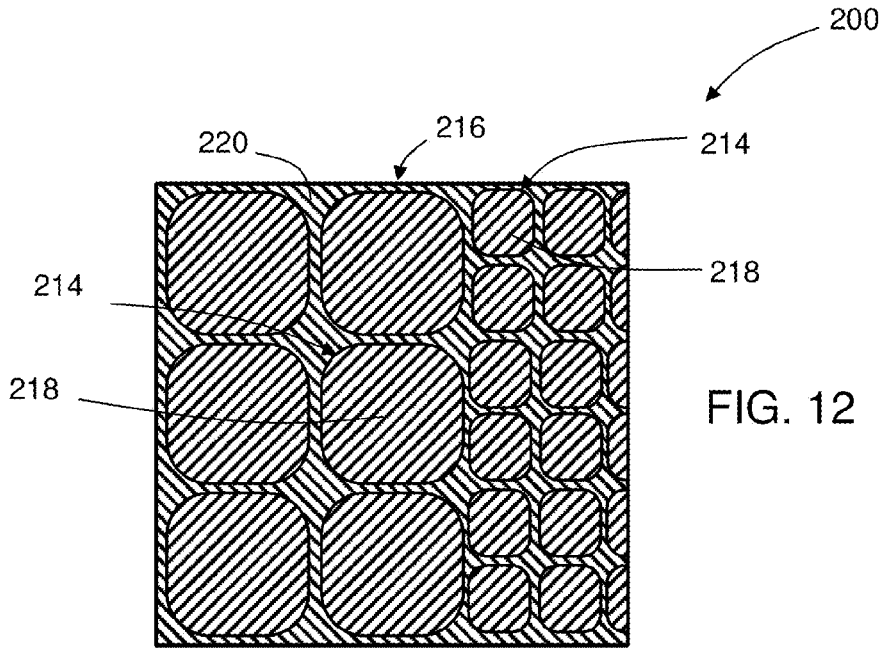
FIG. 12 is a schematic illustration of an exemplary embodiment of a powder compact as disclosed herein having a non-homogeneous, multi-modal distribution of particle sizes.

As illustrated in FIG. 15, in another exemplary embodiment, powder compact 200 is formed from powder particles 12 where the coating layer 16 comprises a multilayer coating layer 16 having a plurality of coating layers, and the resulting nanomatrix 216 between adjacent ones of the plurality of dispersed particles 214 comprises the plurality of layers (t) comprising the coating layer 16 of one particle 12, a bond layer 219, and the plurality of layers comprising the coating layer 16 of another one of powder particles 12. In FIG. 15, this is illustrated with a two-layer metallic coating layer 16, but it will be understood that the plurality of layers of multi-layer metallic coating layer 16 may include any desired number of layers. The thickness (t) of the bond layer 219 is again determined by the extent of the interdiffusion between the plurality of layers of the respective coating layers 16, and may encompass the entire thickness of nanomatrix 216 or only a portion thereof. In this embodiment, the plurality of layers comprising each coating layer 16 may be used to control interdiffusion and formation of bond layer 219 and thickness (t).

In one exemplary embodiment of a powder compact 200 made using powder particles 12 with multilayer coating layers 16, the compact includes dispersed particles 214 comprising Mg, Al, Zn or Mn, or a combination thereof, as described herein, and nanomatrix 216 comprises a cellular network of sintered two-layer coating layers 16, as shown in FIG. 3, comprising first layers 22 that are disposed on the dispersed particles 214 and a second layers 24 that are disposed on the first layers 22. First layers 22 include Al or Ni, or a combination thereof, and second layers 24 include Al, Zn, Mn, Mg, Mo, W, Cu, Fe, Si, Ca, Co, Ta, Re or Ni, or a combination thereof. In these configurations, materials of dispersed particles 214 and multilayer coating layer 16 used to form nanomatrix 216 are selected so that the chemical compositions of adjacent materials are different (e.g. dispersed particle/first layer and first layer/second layer).

In another exemplary embodiment of a powder compact 200 made using powder particles 12 with multilayer coating layers 16, the compact includes dispersed particles 214 comprising Mg, Al, Zn or Mn, or a combination thereof, as described herein, and nanomatrix 216 comprises a cellular network of sintered three-layer metallic coating layers 16, as shown in FIG. 4, comprising first layers 22 that are disposed on the dispersed particles 214, second layers 24 that are disposed on the first layers 22 and third layers 26 that are disposed on the second layers 24. First layers 22 include Al or Ni, or a combination thereof; second layers 24 include Al, Zn, Mn, Mg, Mo, W, Cu, Fe, Si, Ca, Co, Ta, Re or Ni, or an oxide, nitride or carbide thereof, or a combination of any of the aforementioned second layer materials; and the third layers include Al, Zn, Mn, Mg, Mo, W, Cu, Fe, Si, Ca, Co, Ta, Re or Ni, or a combination thereof. The selection of materials is analogous to the selection considerations described herein for powder compact 200 made using two-layer coating layer powders, but must also be extended to include the material used for the third coating layer.

In yet another exemplary embodiment of a powder compact 200 made using powder particles 12 with multilayer coating layers 16, the compact includes dispersed particles 214 comprising Mg, Al, Zn or Mn, or a combination thereof, as described herein, and nanomatrix 216 comprise a cellular network of sintered four-layer coating layers 16 comprising first layers 22 that are disposed on the dispersed particles 214; second layers 24 that are disposed on the first layers 22; third layers 26 that are disposed on the second layers 24 and fourth layers 28 that are disposed on the third layers 26. First layers 22 include Al or Ni, or a combination thereof; second layers 24 include Al, Zn, Mn, Mg, Mo, W, Cu, Fe, Si, Ca, Co, Ta, Re or Ni, or an oxide, nitride or carbide thereof, or a combination of any of the aforementioned second layer materials; third layers include Al, Zn, Mn, Mg, Mo, W, Cu, Fe, Si, Ca, Co, Ta, Re or Ni, or an oxide, nitride or carbide thereof, or a combination of any of the aforementioned third layer materials; and fourth layers include Al, Mn, Fe, Co or Ni, or a combination thereof. The selection of materials is analogous to the selection considerations described herein for powder compacts 200 made using two-layer coating layer powders, but must also be extended to include the material used for the third and fourth coating layers.

In another exemplary embodiment of a powder compact 200, dispersed particles 214 comprise a metal having a standard oxidation potential less than Zn or a non-metallic material, or a combination thereof, as described herein, and nanomatrix 216 comprises a cellular network of sintered metallic coating layers 16. Suitable non-metallic materials include various ceramics, glasses or forms of carbon, or a combination thereof. Further, in powder compacts 200 that include dispersed particles 214 comprising these metals or non-metallic materials, nanomatrix 216 may include Al, Zn, Mn, Mg, Mo, W, Cu, Fe, Si, Ca, Co, Ta, Re or Ni, or an oxide, carbide or nitride thereof, or a combination of any of the aforementioned materials as nanomatrix material 220.

Figure 16:
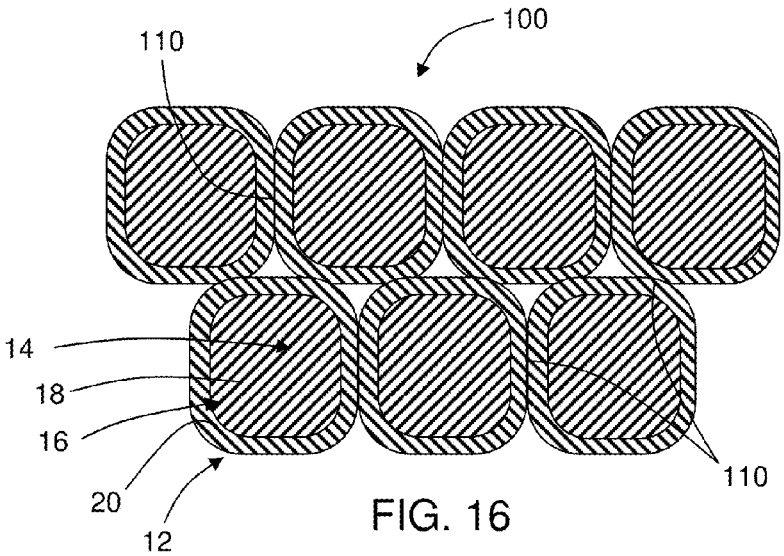
FIG. 16 is a schematic cross-sectional illustration of an exemplary embodiment of a precursor powder compact.

Referring to FIG. 16, sintered powder compact 200 may comprise a sintered precursor powder compact 100 that includes a plurality of deformed, mechanically bonded powder particles as described herein. Precursor powder compact 100 may be formed by compaction of powder 10 to the point that powder particles 12 are pressed into one another, thereby deforming them and forming interparticle mechanical or other bonds 110 associated with this deformation sufficient to cause the deformed powder particles 12 to adhere to one another and form a green-state powder compact having a green density that is less than the theoretical density of a fully-dense compact of powder 10, due in part to interparticle spaces 15. Compaction may be performed, for example, by isostatically pressing powder 10 at room temperature to provide the deformation and interparticle bonding of powder particles 12 necessary to form precursor powder compact 100.

Figure 25:
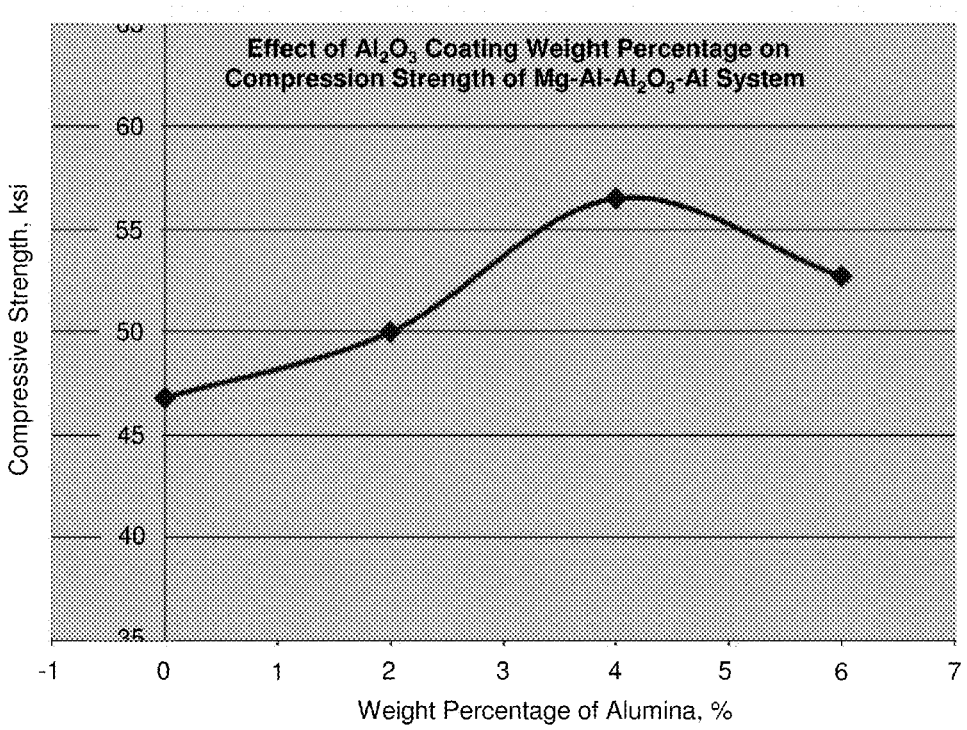
FIG. 25 is a plot of compressive strength of a powder compact as a function the amount of a constituent ($Al_2O_3$) of the cellular nanomatrix.

Sintered and forged powder compacts 200 that include dispersed particles 214 comprising Mg and nanomatrix 216 comprising various nanomatrix materials as described herein have demonstrated an excellent combination of mechanical strength and low density that exemplify the lightweight, high-strength materials disclosed herein. Examples of powder compacts 200 that have pure Mg dispersed particles 214 and various nanomatrices 216 formed from powders 10 having pure Mg particle cores 14 and various single and multilayer metallic coating layers 16 that include Al, Ni, W or $Al_2O_3$, or a combination thereof, and that have been made using the method 400 disclosed herein, are listed in a table as FIG. 18. These powders compacts 200 have been subjected to various mechanical and other testing, including density testing, and their dissolution and mechanical property degradation behavior has also been characterized as disclosed herein. The results indicate that these materials may be configured to provide a wide range of selectable and controllable corrosion or dissolution behavior from very low corrosion rates to extremely high corrosion rates, particularly corrosion rates that are both lower and higher than those of powder compacts that do not incorporate the cellular nanomatrix, such as a compact formed from pure Mg powder through the same compaction and sintering processes in comparison to those that include pure Mg dispersed particles in the various cellular nanomatrices described herein. These powder compacts 200 may also be configured to provide substantially enhanced properties as compared to powder compacts formed from pure Mg particles that do not include the nanoscale coatings described herein. For example, referring to FIGS. 18 and 19, powder compacts 200 that include dispersed particles 214 comprising Mg and nanomatrix 216 comprising various nanomatrix materials 220 described herein have demonstrated room temperature compressive strengths of at least about 37 ksi, and have further demonstrated room temperature compressive strengths in excess of about 50 ksi, both dry and immersed in a solution of 3% KCl at 200° F. In contrast, powder compacts formed from pure Mg powders have a compressive strength of about 20 ksi or less. Strength of the nanomatrix powder metal compact 200 can be further improved by optimizing powder 10, particularly the weight percentage of the nanoscale metallic coating layers 16 that are used to form cellular nanomatrix 216. For example, FIG. 25 shows the effect of varying the weight percentage (wt. %), i.e., thickness, of an alumina coating on the room temperature compressive strength of a powder compact 200 of a cellular nanomatrix 216 formed from coated powder particles 12 that include a multilayer ($Al/Al_2O_3/Al$) metallic coating layer 16 on pure Mg particle cores 14. In this example, optimal strength is achieved at 4 wt % of alumina, which represents an increase of 21% as compared to that of 0 wt % alumina.

Powder compacts 200 comprising dispersed particles 214 that include Mg and nanomatrix 216 that includes various nanomatrix materials as described herein have also demonstrated a room temperature sheer strength of at least about 20 ksi. This is in contrast with powder compacts formed from pure Mg powders which have room temperature sheer strengths of about 8 ksi.

Powder compacts 200 of the types disclosed herein are able to achieve an actual density that is substantially equal to the predetermined theoretical density of a compact material based on the composition of powder 10, including relative amounts of constituents of particle cores 14 and metallic coating layer 16, and are also described herein as being fully-dense powder compacts. Powder compacts 200 comprising dispersed particles that include Mg and nanomatrix 216 that includes various nanomatrix materials as described herein have demonstrated actual densities of about 1.738 g/cm$^3$ to about 2.50 g/cm$^3$, which are substantially equal to the predetermined theoretical densities, differing by at most 4% from the predetermined theoretical densities.

Figures 18, 22:
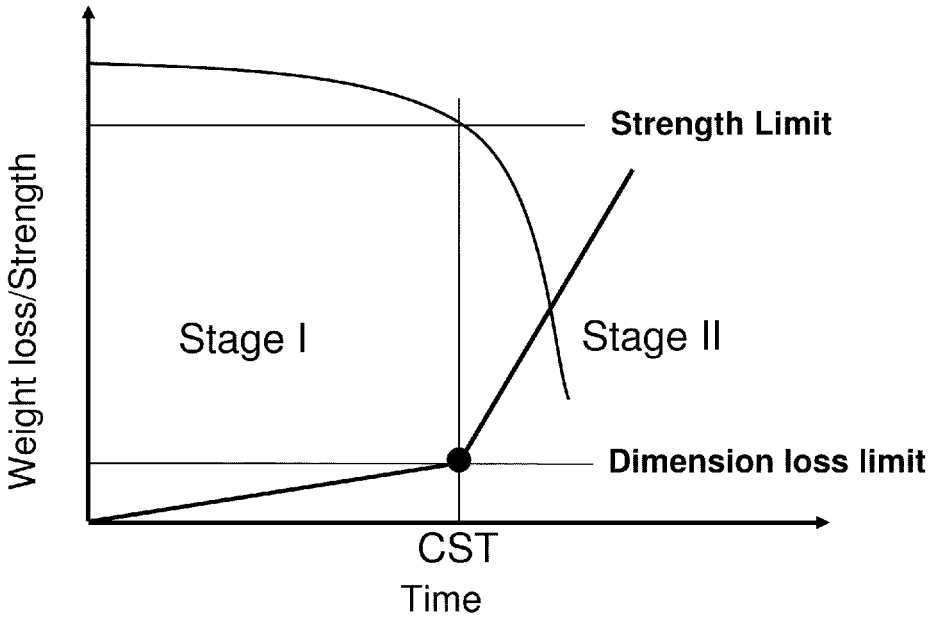
FIG. 18 is a table that describes the particle core and metallic coating layer configurations for powder particles and powders used to make exemplary embodiments of powder compacts for testing as disclosed herein.
FIG. 22 is a schematic illustration of a change in a property of a powder compact as disclosed herein as a function of time and a change in condition of the powder compact environment.
Figure 19:
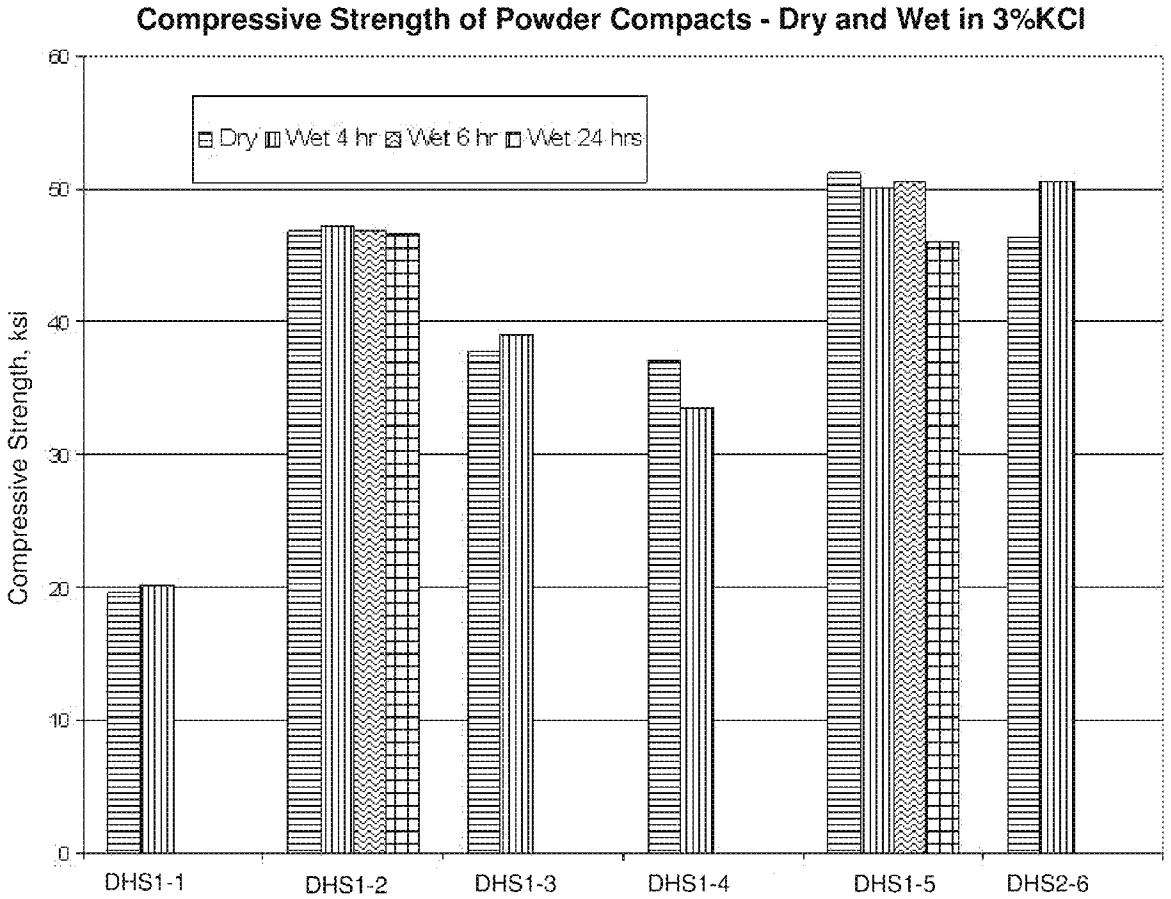
FIG. 19 a plot of the compressive strength of the powder compacts of FIG. 18 both dry and in an aqueous solution comprising 3% KCl.
Figure 20:
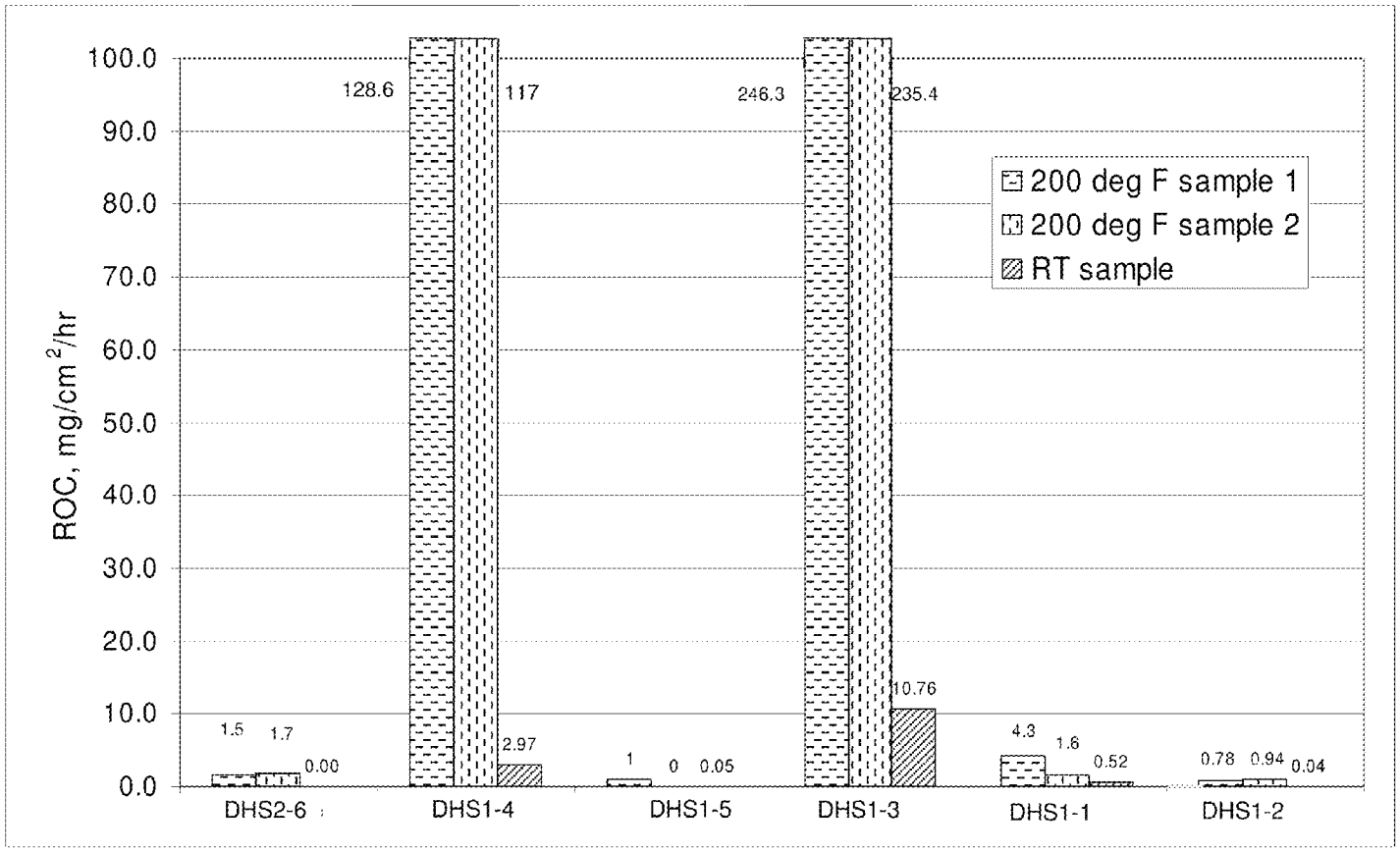
FIG. 20 is a plot of the rate of corrosion (ROC) of the powder compacts of FIG. 18 in an aqueous solution comprising 3% KCl at 200° F. and room temperature.
Figure 21:
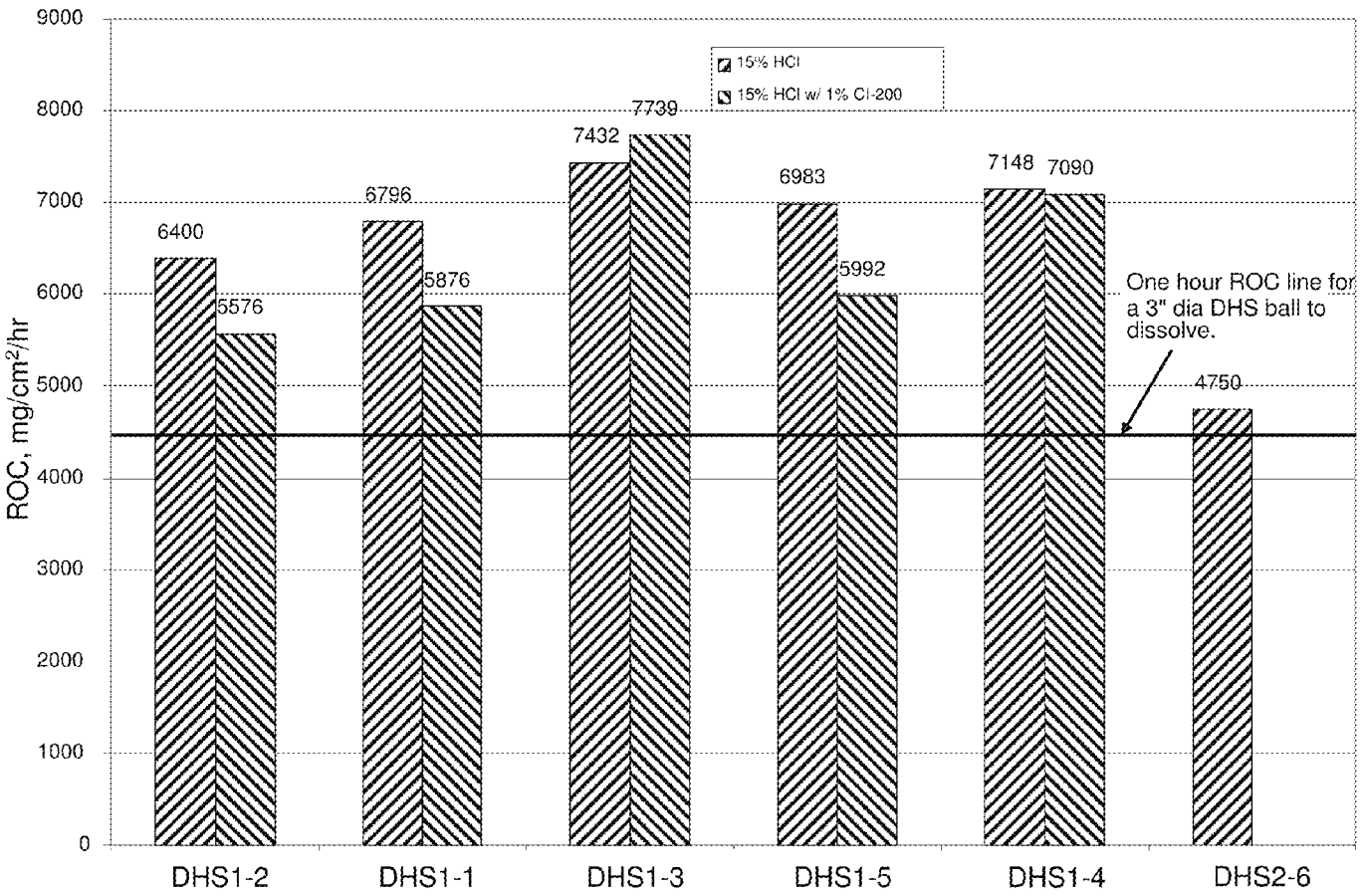
FIG. 21 is a plot of the ROC of the powder compacts of FIG. 18 in 15% HCl.

Powder compacts 200 as disclosed herein may be configured to be selectively and controllably dissolvable in a wellbore fluid in response to a changed condition in a wellbore. Examples of the changed condition that may be exploited to provide selectable and controllable dissolvability include a change in temperature, change in pressure, change in flow rate, change in pH or change in chemical composition of the wellbore fluid, or a combination thereof. An example of a changed condition comprising a change in temperature includes a change in well bore fluid temperature. For example, referring to FIGS. 18 and 20, powder compacts 200 comprising dispersed particles 214 that include Mg and cellular nanomatrix 216 that includes various nanomatrix materials as described herein have relatively low rates of corrosion in a 3% KCl solution at room temperature that ranges from about 0 to about 11 mg/cm$^2$/hr as compared to relatively high rates of corrosion at 200° F. that range from about 1 to about 246 mg/cm$^2$/hr depending on different nanoscale coating layers 16. An example of a changed condition comprising a change in chemical composition includes a change in a chloride ion concentration or pH value, or both, of the wellbore fluid. For example, referring to FIGS. 18 and 21, powder compacts 200 comprising dispersed particles 214 that include Mg and nanomatrix 216 that includes various nanoscale coatings described herein demonstrate corrosion rates in 15% HCl that range from about 4750 mg/cm$^2$/hr to about 7432 mg/cm$^2$/hr. Thus, selectable and controllable dissolvability in response to a changed condition in the wellbore, namely the change in the wellbore fluid chemical composition from KCl to HCl, may be used to achieve a characteristic response as illustrated graphically in FIG. 22, which illustrates that at a selected predetermined critical service time (CST) a changed condition may be imposed upon powder compact 200 as it is applied in a given application, such as a wellbore environment, that causes a controllable change in a property of powder compact 200 in response to a changed condition in the environment in which it is applied. For example, at a predetermined CST changing a wellbore fluid that is in contact with powder contact 200 from a first fluid (e.g. KCl) that provides a first corrosion rate and an associated weight loss or strength as a function of time to a second wellbore fluid (e.g., HCl) that provides a second corrosion rate and associated weight loss and strength as a function of time, wherein the corrosion rate associated with the first fluid is much less than the corrosion rate associated with the second fluid. This characteristic response to a change in wellbore fluid conditions may be used, for example, to associate the critical service time with a dimension loss limit or a minimum strength needed for a particular application, such that when a wellbore tool or component formed from powder compact 200 as disclosed herein is no longer needed in service in the wellbore (e.g., the CST) the condition in the wellbore (e.g., the chloride ion concentration of the wellbore fluid) may be changed to cause the rapid dissolution of powder compact 200 and its removal from the wellbore. In the example described above, powder compact 200 is selectably dissolvable at a rate that ranges from about 0 to about 7000 mg/cm$^2$/hr. This range of response provides, for example the ability to remove a 3 inch diameter ball formed from this material from a wellbore by altering the wellbore fluid in less than one hour. The selectable and controllable dissolvability behavior described above, coupled with the excellent strength and low density properties described herein, define a new engineered dispersed particle-nanomatrix material that is configured for contact with a fluid and configured to provide a selectable and controllable transition from one of a first strength condition to a second strength condition that is lower than a functional strength threshold, or a first weight loss amount to a second weight loss amount that is greater than a weight loss limit, as a function of time in contact with the fluid. The dispersed particle-nanomatrix composite is characteristic of the powder compacts 200 described herein and includes a cellular nanomatrix 216 of nanomatrix material 220, a plurality of dispersed particles 214 including particle core material 218 that is dispersed within the matrix. Nanomatrix 216 is characterized by a solid-state bond layer 219 which extends throughout the nanomatrix. The time in contact with the fluid described above may include the CST as described above. The CST may include a predetermined time that is desired or required to dissolve a predetermined portion of the powder compact 200 that is in contact with the fluid. The CST may also include a time corresponding to a change in the property of the engineered material or the fluid, or a combination thereof. In the case of a change of property of the engineered material, the change may include a change of a temperature of the engineered material. In the case where there is a change in the property of the fluid, the change may include the change in a fluid temperature, pressure, flow rate, chemical composition or pH or a combination thereof. Both the engineered material and the change in the property of the engineered material or the fluid, or a combination thereof, may be tailored to provide the desired CST response characteristic, including the rate of change of the particular property (e.g., weight loss, loss of strength) both prior to the CST (e.g., Stage 1) and after the CST (e.g., Stage 2), as illustrated in FIG. 22.

Figure 17:
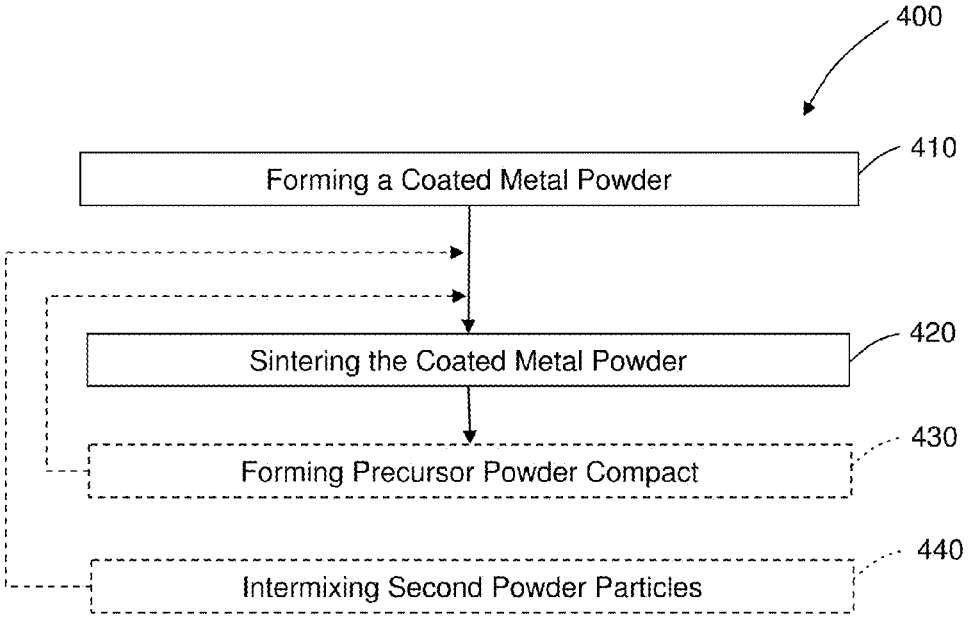
FIG. 17 is a flow chart of an exemplary embodiment of a method of making a powder compact as disclosed herein.

Referring to FIG. 17, a method 400 of making a powder compact 200. Method 400 includes forming 410 a coated metallic powder 10 comprising powder particles 12 having particle cores 14 with nanoscale metallic coating layers 16 disposed thereon, wherein the metallic coating layers 16 have a chemical composition and the particle cores 14 have a chemical composition that is different than the chemical composition of the metallic coating material 16. Method 400 also includes forming 420 a powder compact by applying a predetermined temperature and a predetermined pressure to the coated powder particles sufficient to sinter them by solid-phase sintering of the coated layers of the plurality of the coated particle powders 12 to form a substantially-continuous, cellular nanomatrix 216 of a nanomatrix material 220 and a plurality of dispersed particles 214 dispersed within nanomatrix 216 as described herein.

Forming 410 of coated metallic powder 10 comprising powder particles 12 having particle cores 14 with nanoscale metallic coating layers 16 disposed thereon may be performed by any suitable method. In an exemplary embodiment, forming 410 includes applying the metallic coating layers 16, as described herein, to the particle cores 14, as described herein, using fluidized bed chemical vapor deposition (FBCVD) as described herein. Applying the metallic coating layers 16 may include applying single-layer metallic coating layers 16 or multilayer metallic coating layers 16 as described herein. Applying the metallic coating layers 16 may also include controlling the thickness of the individual layers as they are being applied, as well as controlling the overall thickness of metallic coating layers 16. Particle cores 14 may be formed as described herein.

Forming 420 of the powder compact 200 may include any suitable method of forming a fully-dense compact of powder 10. In an exemplary embodiment, forming 420 includes dynamic forging of a green-density precursor powder compact 100 to apply a predetermined temperature and a predetermined pressure sufficient to sinter and deform the powder particles and form a fully-dense nanomatrix 216 and dispersed particles 214 as described herein. Dynamic forging as used herein means dynamic application of a load at temperature and for a time sufficient to promote sintering of the metallic coating layers 16 of adjacent powder particles 12, and may preferably include application of a dynamic forging load at a predetermined loading rate for a time and at a temperature sufficient to form a sintered and fully-dense powder compact 200. In an exemplary embodiment, dynamic forging included: 1) heating a precursor or green-state powder compact 100 to a predetermined solid phase sintering temperature, such as, for example, a temperature sufficient to promote interdiffusion between metallic coating layers 16 of adjacent powder particles 12; 2) holding the precursor powder compact 100 at the sintering temperature for a predetermined hold time, such as, for example, a time sufficient to ensure substantial uniformity of the sintering temperature throughout the precursor compact 100; 3) forging the precursor powder compact 100 to full density, such as, for example, by applying a predetermined forging pressure according to a predetermined pressure schedule or ramp rate sufficient to rapidly achieve full density while holding the compact at the predetermined sintering temperature; and 4) cooling the compact to room temperature. The predetermined pressure and predetermined temperature applied during forming 420 will include a sintering temperature, $T_S$, and forging pressure, $P_F$, as described herein that will ensure solid-state sintering and deformation of the powder particles 12 to form fully-dense powder compact 200, including solid-state bond 217 and bond layer 219. The steps of heating to and holding the precursor powder compact 100 at the predetermined sintering temperature for the predetermined time may include any suitable combination of temperature and time, and will depend, for example, on the powder 10 selected, including the materials used for particle core 14 and metallic coating layer 16, the size of the precursor powder compact 100, the heating method used and other factors that influence the time needed to achieve the desired temperature and temperature uniformity within precursor powder compact 100. In the step of forging, the predetermined pressure may include any suitable pressure and pressure application schedule or pressure ramp rate sufficient to achieve a fully-dense powder compact 200, and will depend, for example, on the material properties of the powder particles 12 selected, including temperature dependent stress/strain characteristics (e.g., stress/strain rate characteristics), interdiffusion and metallurgical thermodynamic and phase equilibria characteristics, dislocation dynamics and other material properties. For example, the maximum forging pressure of dynamic forging and the forging schedule (i.e., the pressure ramp rates that correspond to strain rates employed) may be used to tailor the mechanical strength and toughness of the powder compact. The maximum forging pressure and forging ramp rate (i.e., strain rate) is the pressure just below the compact cracking pressure, i.e., where dynamic recovery processes are unable to relieve strain energy in the compact microstructure without the formation of a crack in the compact. For example, for applications that require a powder compact that has relatively higher strength and lower toughness, relatively higher forging pressures and ramp rates may be used. If relatively higher toughness of the powder compact is needed, relatively lower forging pressures and ramp rates may be used.

For certain exemplary embodiments of powders 10 described herein and precursor compacts 100 of a size sufficient to form many wellbore tools and components, predetermined hold times of about 1 to about 5 hours may be used. The predetermined sintering temperature, $T_S$, will preferably be selected as described herein to avoid melting of either particle cores 14 and metallic coating layers 16 as they are transformed during method 400 to provide dispersed particles 214 and nanomatrix 216. For these embodiments, dynamic forging may include application of a forging pressure, such as by dynamic pressing to a maximum of about 80 ksi at pressure ramp rate of about 0.5 to about 2 ksi/second.

In an exemplary embodiment where particle cores 14 included Mg and metallic coating layer 16 included various single and multilayer coating layers as described herein, such as various single and multilayer coatings comprising Al, the dynamic forging was performed by sintering at a temperature, $T_S$, of about 450° C. to about 470° C. for up to about 1 hour without the application of a forging pressure, followed by dynamic forging by application of isostatic pressures at ramp rates between about 0.5 to about 2 ksi/second to a maximum pressure, $P_S$, of about 30 ksi to about 60 ksi, which resulted in forging cycles of 15 seconds to about 120 seconds. The short duration of the forging cycle is a significant advantage as it limits interdiffusion, including interdiffusion within a given metallic coating layer 16, interdiffusion between adjacent metallic coating layers 16 and interdiffusion between metallic coating layers 16 and particle cores 14, to that needed to form metallurgical bond 217 and bond layer 219, while also maintaining the desirable equiaxed dispersed particle 214 shape with the integrity of cellular nanomatrix 216 strengthening phase. The duration of the dynamic forging cycle is much shorter than the forming cycles and sintering times required for conventional powder compact forming processes, such as hot isostatic pressing (HIP), pressure assisted sintering or diffusion sintering.

Method 400 may also optionally include forming 430 a precursor powder compact by compacting the plurality of coated powder particles 12 sufficiently to deform the particles and form interparticle bonds to one another and form the precursor powder compact 100 prior to forming 420 the powder compact. Compacting may include pressing, such as isostatic pressing, of the plurality of powder particles 12 at room temperature to form precursor powder compact 100. Compacting 430 may be performed at room temperature. In an exemplary embodiment, powder 10 may include particle cores 14 comprising Mg and forming 430 the precursor powder compact may be performed at room temperature at an isostatic pressure of about 10 ksi to about 60 ksi.

Method 400 may optionally also include intermixing 440 a second powder 30 into powder 10 as described herein prior to the forming 420 the powder compact, or forming 430 the precursor powder compact.

Figure 23:
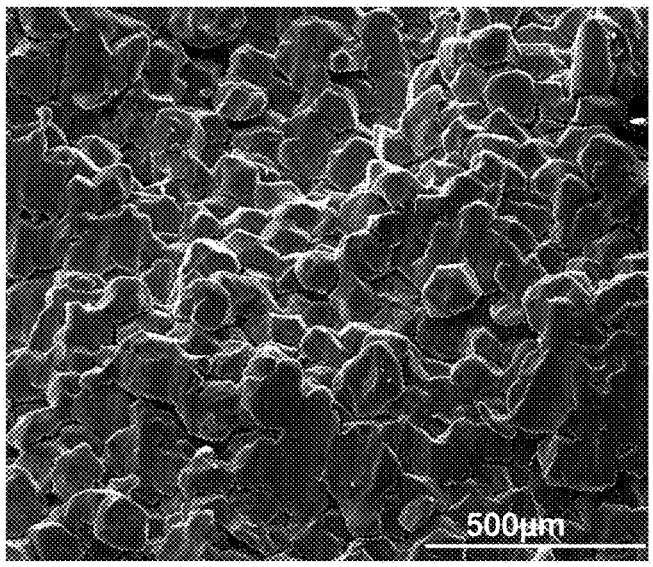
FIG. 23 is an electron photomicrograph of a fracture surface of a powder compact formed from a pure Mg powder.
Figure 24:
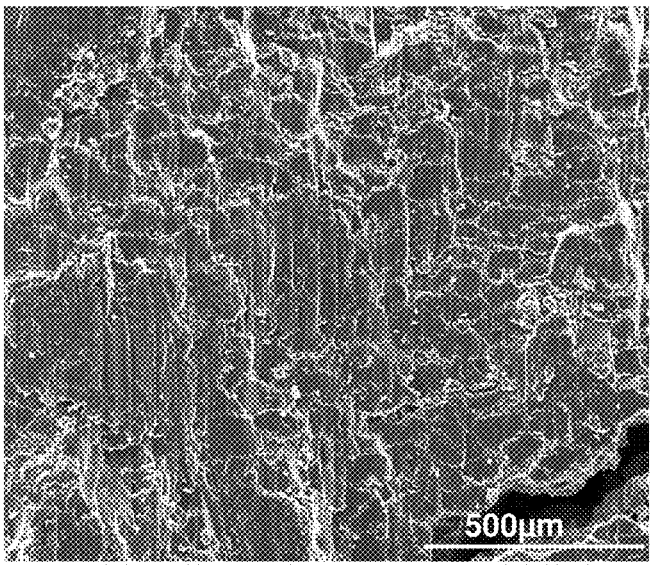
FIG. 24 is an electron photomicrograph of a fracture surface of an exemplary embodiment of a powder metal compact as described herein.

Without being limited by theory, powder compacts 200 are formed from coated powder particles 12 that include a particle core 14 and associated core material 18 as well as a metallic coating layer 16 and an associated metallic coating material 20 to form a substantially-continuous, three-dimensional, cellular nanomatrix 216 that includes a nanomatrix material 220 formed by sintering and the associated diffusion bonding of the respective coating layers 16 that includes a plurality of dispersed particles 214 of the particle core materials 218. This unique structure may include metastable combinations of materials that would be very difficult or impossible to form by solidification from a melt having the same relative amounts of the constituent materials. The coating layers and associated coating materials may be selected to provide selectable and controllable dissolution in a predetermined fluid environment, such as a wellbore environment, where the predetermined fluid may be a commonly used wellbore fluid that is either injected into the wellbore or extracted from the wellbore. As will be further understood from the description herein, controlled dissolution of the nanomatrix exposes the dispersed particles of the core materials. The particle core materials may also be selected to also provide selectable and controllable dissolution in the wellbore fluid. Alternately, they may also be selected to provide a particular mechanical property, such as compressive strength or sheer strength, to the powder compact 200, without necessarily providing selectable and controlled dissolution of the core materials themselves, since selectable and controlled dissolution of the nanomatrix material surrounding these particles will necessarily release them so that they are carried away by the wellbore fluid. The microstructural morphology of the substantially-continuous, cellular nanomatrix 216, which may be selected to provide a strengthening phase material, with dispersed particles 214, which may be selected to provide equiaxed dispersed particles 214, provides these powder compacts with enhanced mechanical properties, including compressive strength and sheer strength, since the resulting morphology of the nanomatrix/dispersed particles can be manipulated to provide strengthening through the processes that are akin to traditional strengthening mechanisms, such as grain size reduction, solution hardening through the use of impurity atoms, precipitation or age hardening and strength/work hardening mechanisms. The nanomatrix/dispersed particle structure tends to limit dislocation movement by virtue of the numerous particle nanomatrix interfaces, as well as interfaces between discrete layers within the nanomatrix material as described herein. This is exemplified in the fracture behavior of these materials, as illustrated in FIGS. 23 and 24. In FIG. 23, a powder compact 200 made using uncoated pure Mg powder and subjected to a shear stress sufficient to induce failure demonstrated intergranular fracture. In contrast, in FIG. 24, a powder compact 200 made using powder particles 12 having pure Mg powder particle cores 14 to form dispersed particles 214 and metallic coating layers 16 that includes Al to form nanomatrix 216 and subjected to a shear stress sufficient to induce failure demonstrated transgranular fracture and a substantially higher fracture stress as described herein. Because these materials have high-strength characteristics, the core material and coating material may be selected to utilize low density materials or other low density materials, such as low-density metals, ceramics, glasses or carbon, that otherwise would not provide the necessary strength characteristics for use in the desired applications, including wellbore tools and components.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A metallic powder comprising a plurality of metallic powder particles disposed in a powder compact, each powder particle comprising:

a particle core, the particle core comprises a core material comprising Mg, Al, Zn or Mn, or a combination thereof; and a metallic coating layer disposed on the particle core and comprising a metallic coating material, wherein the metallic coating layer comprises a plurality of coating layers, and wherein a first coating layer comprises Al, a second coating layer comprises Al, Zn, Mn, Mg, Mo, W, Cu, Fe, Si, Ca, Co, Ta, Re, or Ni, or an oxide, nitride or carbide thereof, or a combination of any of the aforementioned second coating layer materials, and a third coating layer comprises Al, Zn, Mn, Mg, Mo, W, Fe, Si, Ca, Co, Ta, Re, or Ni, or a combination thereof, wherein the first coating layer has a chemical composition that is different than a chemical composition of the second coating layer, and the chemical composition of the second coating layer is different than a chemical composition of the third layer, and wherein the powder compact of the powder particles is selectively and controllably dissolvable in a predetermined wellbore fluid comprising potassium chloride, hydrochloric acid, calcium chloride, calcium bromide or zinc bromide.

2. The metal powder of claim 1, wherein the particle core has a diameter of about 5 μm to about 300 μm.

3. The metal powder of claim 1, wherein the core material is a binary Mg—Zn, Al—Zn, Mg—Mn, Zn—Mn alloy, or a tertiary Mg—Zn—Y alloy.

4. The metal powder of claim 1, wherein the core material is a tertiary Mg—Al—X alloy, wherein X is Zn, Mn, Si, Ca or Y, or a combination thereof.

5. The metal powder of claim 4, wherein the Mg—Al—X alloy comprises, by weight, up to about 85% Mg, up to about 15% Al and up to about 5% X.

6. The metal powder of claim 1, wherein the core material further comprises a rare earth element.

7. The metal powder of claim 6, wherein the rare earth element comprises, by weight, less than about 5% of the particle core.

8. The metal powder of claim 1, wherein the metallic coating material has a chemical composition and the core material has a chemical composition that is different than the chemical composition of the coating material.

9. The metal powder of claim 1, wherein the coating layer has a thickness of about 25 nm to about 2500 nm.

10. The metal powder of claim 1, further comprising a fourth coating layer that is disposed on the third coating layer.

11. The metal powder of claim 1, wherein the fourth coating layer comprises Al, Mn, Fe, Co or Ni, or a combination thereof, and wherein the chemical composition of the third coating layer is different than a chemical composition of the fourth coating layer.

12. A metallic powder comprising a plurality of metallic powder particles, each powder particle comprising:

a particle core, the particle core comprises a core material comprising a metal having a standard oxidation potential less than Zn, ceramic, glass, or carbon, or a combination thereof; and a metallic coating layer disposed on the particle core and comprising a metallic coating material, wherein the metallic coating layer comprises a plurality of coating layers, and wherein a first coating layer comprises Al, a second coating layer comprises Al, Zn, Mn, Mg, Mo, W, Cu, Fe, Si, Ca, Co, Ta, Re, or Ni, or an oxide, nitride or carbide thereof, or a combination of any of the aforementioned second coating layer materials, and a third coating layer comprises Al, Zn, Mn, Mg, Mo, W, Fe, Si, Ca, Co, Ta, Re, or Ni, or a combination thereof, wherein the first coating layer has a chemical composition that is different than a chemical composition of the second coating layer, and the chemical composition of the second coating layer is different than a chemical composition of the third layer, and wherein the second coating layer is configured to provide at least one of enhanced interlayer adhesion, enhanced strength of the overall metallic coating layer, or limited interlayer diffusion.

13. The metallic powder of claim 12, wherein the metallic coating material has a chemical composition and the core material has a chemical composition that is different than the chemical composition of the coating material.

14. A method of making a metal powder, comprising:

forming a metal powder comprising a plurality of powder particles of a binary Mg—Zn, Mg—Mn, Al—Zn, Al—Mn, or Zn—Mn alloy, or a tertiary Mg—Zn—Y alloy, or a tertiary Mg—Al—X alloy, wherein X is Zn, Mn, Si, Ca, or Y, or a combination thereof, as a core material for use as a plurality of particle cores; and depositing a metallic coating layer on each of the plurality of particle cores, wherein the metallic coating layer comprises a plurality of coating layers, and wherein a first coating layer comprises Al, a second coating layer comprises Al, Zn, Mn, Mg, Mo, W, Cu, Fe, Si, Ca, Co, Ta, Re, or Ni, or an oxide, nitride or carbide thereof, or a combination of any of the aforementioned second coating layer materials, and a third coating layer comprises Al, Zn, Mn, Mg, Mo, W, Fe, Si, Ca, Co, Ta, Re, or Ni, or a combination thereof, wherein the first coating layer has a chemical composition that is different than a chemical composition of the second coating layer, and the chemical composition of the second coating layer is different than a chemical composition of the third layer, and wherein the second coating layer is configured to provide at least one of enhanced interlayer adhesion, enhanced strength of the overall metallic coating layer, or limited interlayer diffusion.

15. The method of claim 14, wherein forming the metal powder comprises vacuum spray forming or inert gas spray forming.

16. The method of claim 14, wherein depositing the coating layer comprises depositing the coating material by fluidized bed chemical vapor deposition.

17. The method of claim 14, wherein depositing the metallic coating layer comprises depositing the first coating layer comprising Al or Ni, or a combination thereof, on the particle core.

* * * * *